US007402777B2

(12) United States Patent
Ron et al.

(10) Patent No.: US 7,402,777 B2
(45) Date of Patent: Jul. 22, 2008

(54) STABLE INITIATOR COMPOSITIONS AND IGNITERS

(75) Inventors: Hale L. Ron, Woodside, CA (US); Mingzu Lei, Mountain View, CA (US); Hilary N. Pettit, Newark, CA (US); Dennis W. Solas, San Francisco, CA (US); Soonho Song, Palo Alto, CA (US); Curtis Tom, San Mateo, CA (US)

(73) Assignee: Alexza Pharmaceuticals, Inc., Palo Alto, CA (US)

( * ) Notice: Subject to any disclaimer, the term of this patent is extended or adjusted under 35 U.S.C. 154(b) by 114 days.

(21) Appl. No.: 10/851,018

(22) Filed: May 20, 2004

(65) Prior Publication Data

US 2005/0258159 A1 Nov. 24, 2005

(51) Int. Cl.
*F23Q 7/22* (2006.01)

(52) U.S. Cl. ..... 219/270; 219/260

(58) Field of Classification Search ..... None
See application file for complete search history.

(56) References Cited

U.S. PATENT DOCUMENTS

| | | | |
|---|---|---|---|
| 802,256 | A | 10/1905 | Bamberger et al. |
| 2,024,225 | A | 12/1935 | Igari |
| 2,280,598 | A | 4/1942 | Meridith |
| 2,500,790 | A | 3/1950 | Bennett |
| 2,531,548 | A | 11/1950 | Bennett |
| 2,624,332 | A | 1/1953 | Lang |
| 2,906,094 | A | 9/1959 | Damon et al. |
| 2,953,443 | A | 9/1960 | Lloyd |
| 2,999,460 | A | 9/1961 | Stinger et al. |
| 3,118,798 | A | 1/1964 | Winkler |
| 3,150,020 | A | 9/1964 | Kilmer |
| 3,160,097 | A | 12/1964 | Colburn, Jr. et al. |
| 3,238,076 | A | 3/1966 | Taylor et al. |
| 3,311,459 | A | 3/1967 | Francis et al. |
| 3,363,559 | A | 1/1968 | Estes |
| 3,503,814 | A | 3/1970 | Helms, Jr. et al. |
| 3,535,063 | A | 10/1970 | Anderson et al. |
| 3,575,714 | A | 4/1971 | Bennett et al. |

(Continued)

FOREIGN PATENT DOCUMENTS

| | | |
|---|---|---|
| DE | 571 289 | 2/1933 |

(Continued)

OTHER PUBLICATIONS

U.S. Appl. No. 10/633,876, filed Aug. 4, 2003, Hale et al.

(Continued)

*Primary Examiner*—Thor S. Campbell
(74) *Attorney, Agent, or Firm*—William L. Leschensky; Swanson & Bratschun, L.L.C.

(57) ABSTRACT

High sparking initiator compositions with a controlled amount of power are disclosed. The initiator compositions comprise a metal containing oxidizing agent, at least one metal reducing agent, and a non-explosive binder. Low voltage igniters that provide bidirectional plumes upon ignition are also disclosed. These igniters have a electrically resistive element positioned across a hole in a support which directs the plume. These igniters and compositions are useful in the actuation of solid fuel heating unit, in particular, sealed heating units.

24 Claims, 8 Drawing Sheets

U.S. PATENT DOCUMENTS

| | | | | |
|---|---|---|---|---|
| 3,695,179 | A | | 10/1972 | Rainone et al. |
| 3,703,144 | A | | 11/1972 | Colburn, Jr. |
| 3,724,990 | A | | 4/1973 | Schupp |
| 3,724,991 | A | | 4/1973 | Schupp |
| 3,730,669 | A | | 5/1973 | Shaffer |
| 3,791,302 | A | | 2/1974 | McLeod |
| 3,792,302 | A | | 2/1974 | McLeod |
| 3,828,676 | A | * | 8/1974 | Junker ..... 102/530 |
| 3,830,671 | A | | 8/1974 | McArdle |
| 3,893,798 | A | | 7/1975 | Sterling |
| 4,000,022 | A | | 12/1976 | Beckert et al. |
| 4,013,061 | A | | 3/1977 | Trumble et al. |
| 4,025,285 | A | | 5/1977 | Brown |
| 4,047,483 | A | | 9/1977 | Williams |
| 4,053,337 | A | | 10/1977 | Collins |
| 4,059,388 | A | | 11/1977 | Shaffer |
| 4,078,881 | A | | 3/1978 | Anderson et al. |
| 4,096,549 | A | | 6/1978 | Anderson, et al. |
| 4,130,082 | A | | 12/1978 | Bouchard et al. |
| 4,158,084 | A | | 6/1979 | Prentice |
| 4,193,388 | A | | 3/1980 | Frosch et al. |
| 4,205,673 | A | | 6/1980 | Wise et al. |
| 4,329,924 | A | | 5/1982 | Lagofun |
| 4,354,432 | A | | 10/1982 | Cannavo et al. |
| 4,372,210 | A | | 2/1983 | Shaffer et al. |
| 4,372,213 | A | | 2/1983 | Rozner et al. |
| 4,374,686 | A | | 2/1983 | Davitt et al. |
| 4,419,153 | A | | 12/1983 | Boberg |
| 4,484,960 | A | | 11/1984 | Rucker |
| 4,526,758 | A | | 7/1985 | Alengoz et al. |
| 4,671,270 | A | | 6/1987 | Kato |
| 4,700,629 | A | | 10/1987 | Benson |
| 4,721,224 | A | | 1/1988 | Kawabata |
| 4,735,217 | A | | 4/1988 | Gerth et al. |
| 4,757,764 | A | | 7/1988 | Thureson et al. |
| 4,853,052 | A | | 8/1989 | Calsson et al. |
| 4,892,109 | A | | 1/1990 | Strubel |
| 4,917,119 | A | | 4/1990 | Potter et al. |
| 4,922,901 | A | | 5/1990 | Brooks et al. |
| 4,941,483 | A | | 7/1990 | Ridings et al. |
| 4,947,874 | A | | 8/1990 | Brooks et al. |
| 4,947,875 | A | | 8/1990 | Brooks et al. |
| 5,027,707 | A | | 7/1991 | Mei et al. |
| 5,135,009 | A | | 8/1992 | Muller et al. |
| 5,285,798 | A | | 2/1994 | Banerjee et al. |
| 5,322,018 | A | | 6/1994 | Hadden et al. |
| 5,357,984 | A | | 10/1994 | Farrier et al. |
| 5,445,606 | A | | 8/1995 | Haak et al. |
| 5,454,363 | A | | 10/1995 | Sata |
| 5,479,919 | A | | 1/1996 | Buchtal |
| 5,507,277 | A | | 4/1996 | Rubsamen et al. |
| 5,509,354 | A | | 4/1996 | Dorffler et al. |
| 5,538,020 | A | | 7/1996 | Farrier et al. |
| 5,549,849 | A | | 8/1996 | Namura et al. |
| 5,573,565 | A | | 11/1996 | Dalton et al. |
| 5,593,792 | A | | 1/1997 | Farrier et al. |
| 5,623,115 | A | * | 4/1997 | Lauritzen et al. ..... 102/288 |
| 5,626,360 | A | * | 5/1997 | Lauritzen et al. ..... 280/741 |
| 5,641,938 | A | | 6/1997 | Holland et al. |
| 5,654,520 | A | | 8/1997 | Boberg et al. |
| 5,672,843 | A | | 9/1997 | Evans et al. |
| 5,686,691 | A | | 11/1997 | Hamilton et al. |
| 5,694,919 | A | | 12/1997 | Rubsamen et al. |
| 5,697,896 | A | | 12/1997 | McNichols et al. |
| 5,735,263 | A | | 4/1998 | Rubsamen et al. |
| 5,763,813 | A | | 6/1998 | Avory et al. |
| 5,769,621 | A | | 6/1998 | Early et al. |
| 5,819,756 | A | | 10/1998 | Mielordt |
| 5,845,933 | A | * | 12/1998 | Walker et al. ..... 280/741 |
| 6,014,972 | A | | 1/2000 | Sladek |
| 6,080,248 | A | | 6/2000 | Finck et al. |
| 6,102,036 | A | | 8/2000 | Slutsky et al. |
| 6,131,570 | A | | 10/2000 | Schuster et al. |
| 6,155,268 | A | | 12/2000 | Takeuchi |
| 6,168,661 | B1 | | 1/2001 | Dinkelman |
| 6,234,167 | B1 | | 5/2001 | Cox et al. |
| 6,263,872 | B1 | | 7/2001 | Schuster et al. |
| 6,267,110 | B1 | | 7/2001 | Tenenboum et al. |
| 6,289,813 | B1 | | 9/2001 | Duguet et al. |
| 6,289,889 | B1 | | 9/2001 | Bell et al. |
| 6,324,979 | B1 | | 12/2001 | Troianello |
| 6,352,506 | B1 | | 3/2002 | Eppstein et al. |
| 6,478,903 | B1 | | 11/2002 | John, Jr. et al. |
| 6,487,971 | B1 | | 12/2002 | Anderson |
| 6,491,233 | B2 | | 12/2002 | Nichols |
| 6,497,780 | B1 | | 12/2002 | Carlson |
| 6,506,454 | B2 | | 1/2003 | Ishigami |
| 6,516,796 | B1 | | 2/2003 | Cox et al. |
| 6,557,552 | B1 | | 5/2003 | Cox et al. |
| 6,568,390 | B2 | | 5/2003 | Nichols et al. |
| 6,682,716 | B2 | | 1/2004 | Hodges et al. |
| 6,716,415 | B2 | | 4/2004 | Rabinowitz et al. |
| 6,716,416 | B2 | | 4/2004 | Rabinowitz et al. |
| 6,716,417 | B2 | | 4/2004 | Rabinowitz et al. |
| 6,737,042 | B2 | | 5/2004 | Rabinowitz et al. |
| 6,737,043 | B2 | | 5/2004 | Rabinowitz et al. |
| 6,740,307 | B2 | | 5/2004 | Rabinowitz et al. |
| 6,740,308 | B2 | | 5/2004 | Rabinowitz et al. |
| 6,740,309 | B2 | | 5/2004 | Rabinowitz et al. |
| 6,743,415 | B2 | | 6/2004 | Rabinowitz et al. |
| 6,759,029 | B2 | | 7/2004 | Hale et al. |
| 6,776,978 | B2 | | 8/2004 | Rabinowitz et al. |
| 6,780,399 | B2 | | 8/2004 | Rabinowitz et al. |
| 6,780,400 | B2 | | 8/2004 | Rabinowitz et al. |
| 6,783,753 | B2 | | 8/2004 | Rabinowitz et al. |
| 6,797,259 | B2 | | 9/2004 | Rabinowitz et al. |
| 6,803,031 | B2 | | 10/2004 | Rabinowitz et al. |
| 6,805,853 | B2 | | 10/2004 | Rabinowitz et al. |
| 6,805,854 | B2 | | 10/2004 | Hale et al. |
| 6,814,954 | B2 | | 11/2004 | Rabinowitz et al. |
| 6,814,955 | B2 | | 11/2004 | Rabinowitz et al. |
| 6,855,310 | B2 | | 2/2005 | Rabinowitz et al. |
| 6,884,408 | B2 | | 4/2005 | Rabinowitz et al. |
| 6,993,811 | B2 | | 2/2006 | Das et al. |
| 6,994,843 | B2 | | 2/2006 | Rabinowitz et al. |
| 7,005,121 | B2 | | 2/2006 | Rabinowitz et al. |
| 7,005,122 | B2 | | 2/2006 | Hale et al. |
| 7,008,615 | B2 | | 3/2006 | Rabinowitz et al. |
| 7,008,616 | B2 | | 3/2006 | Rabinowitz et al. |
| 7,011,819 | B2 | | 3/2006 | Hale et al. |
| 7,011,820 | B2 | | 3/2006 | Rabinowitz et al. |
| 7,014,840 | B2 | | 3/2006 | Hale et al. |
| 7,014,841 | B2 | | 3/2006 | Rabinowitz et al. |
| 7,018,619 | B2 | | 3/2006 | Rabinowitz et al. |
| 7,018,620 | B2 | | 3/2006 | Rabinowitz et al. |
| 7,018,621 | B2 | | 3/2006 | Hale et al. |
| 7,022,312 | B2 | | 4/2006 | Rabinowitz et al. |
| 7,029,658 | B2 | | 4/2006 | Rabinowitz et al. |
| 7,033,575 | B2 | | 4/2006 | Rabinowitz et al. |
| 7,045,118 | B2 | | 5/2006 | Rabinowitz et al. |
| 7,045,119 | B2 | | 5/2006 | Rabinowitz et al. |
| 7,048,909 | B2 | | 5/2006 | Rabinowitz et al. |
| 7,052,679 | B2 | | 5/2006 | Rabinowitz et al. |
| 7,052,680 | B2 | | 5/2006 | Rabinowitz et al. |
| 7,060,254 | B2 | | 6/2006 | Rabinowitz et al. |
| 7,060,255 | B2 | | 6/2006 | Rabinowitz et al. |
| 7,063,830 | B2 | | 6/2006 | Rabinowitz et al. |
| 7,063,831 | B2 | | 6/2006 | Rabinowitz et al. |
| 7,063,832 | B2 | | 6/2006 | Rabinowitz et al. |
| 7,067,114 | B2 | | 6/2006 | Rabinowitz et al. |
| 7,070,761 | B2 | | 7/2006 | Rabinowitz et al. |
| 7,070,762 | B2 | | 7/2006 | Rabinowitz et al. |
| 7,070,763 | B2 | | 7/2006 | Rabinowitz et al. |
| 7,070,764 | B2 | | 7/2006 | Rabinowitz et al. |

| | | | |
|---|---|---|---|
| 7,070,765 | B2 | 7/2006 | Rabinowitz et al. |
| 7,070,766 | B2 | 7/2006 | Rabinowitz et al. |
| 7,078,016 | B2 | 7/2006 | Rabinowitz et al. |
| 7,078,017 | B2 | 7/2006 | Rabinowitz et al. |
| 7,078,018 | B2 | 7/2006 | Rabinowitz et al. |
| 7,078,019 | B2 | 7/2006 | Rabinowitz et al. |
| 7,078,020 | B2 | 7/2006 | Rabinowitz et al. |
| 7,087,216 | B2 | 8/2006 | Rabinowitz et al. |
| 7,087,217 | B2 | 8/2006 | Rabinowitz et al. |
| 7,087,218 | B2 | 8/2006 | Rabinowitz et al. |
| 7,090,830 | B2 | 8/2006 | Hale et al. |
| 7,094,392 | B2 | 8/2006 | Rabinowitz et al. |
| 7,108,847 | B2 | 9/2006 | Rabinowitz et al. |
| 7,115,250 | B2 | 10/2006 | Rabinowitz et al. |
| 7,169,378 | B2 | 1/2007 | Rabinowitz et al. |
| 2001/0037104 | A1 | 11/2001 | Zhang et al. |
| 2001/0042546 | A1 | 11/2001 | Umeda et al. |
| 2002/0000225 | A1 | 1/2002 | Schuler et al. |
| 2002/0035945 | A1 | 3/2002 | Knowlton et al. |
| 2002/0037437 | A1 | 3/2002 | Yamamoto |
| 2002/0078946 | A1 | 6/2002 | Sprinkel, Jr. et al. |
| 2002/0078955 | A1 | 6/2002 | Nichols et al. |
| 2002/0097139 | A1 | 7/2002 | Gerber et al. |
| 2002/0117175 | A1 | 8/2002 | Kottayil et al. |
| 2003/0015196 | A1 | 1/2003 | Hodges et al. |
| 2003/0015197 | A1 | 1/2003 | Hale et al. |
| 2003/0032638 | A1 | 2/2003 | Kim et al. |
| 2003/0037437 | A1 | 2/2003 | Das et al. |
| 2003/0051728 | A1 | 3/2003 | Lloyd et al. |
| 2003/0062042 | A1 | 4/2003 | Wensley et al. |
| 2003/0070738 | A1 | 4/2003 | Hamilton |
| 2003/0106551 | A1 | 6/2003 | Sprinkel |
| 2003/0118512 | A1 | 6/2003 | Shen |
| 2003/0131843 | A1 | 7/2003 | Lu |
| 2003/0138508 | A1 | 7/2003 | Novack et al. |
| 2003/0209240 | A1 | 11/2003 | Hale et al. |
| 2004/0009128 | A1 | 1/2004 | Rabinowitz et al. |
| 2004/0083919 | A1 | 5/2004 | Hosey et al. |
| 2004/0096402 | A1 | 5/2004 | Hodges et al. |
| 2004/0099266 | A1 | 5/2004 | Cross et al. |
| 2004/0101481 | A1 | 5/2004 | Hale et al. |
| 2004/0102434 | A1 | 5/2004 | Hale et al. |
| 2004/0105818 | A1 | 6/2004 | Every et al. |
| 2004/0105819 | A1 | 6/2004 | Hale et al. |
| 2004/0162517 | A1 | 8/2004 | Furst et al. |
| 2005/0034723 | A1 | 2/2005 | Bennett et al. |
| 2005/0037506 | A1 | 2/2005 | Hale et al. |
| 2005/0126562 | A1 | 6/2005 | Rabinowitz et al. |
| 2005/0131739 | A1 | 6/2005 | Rabinowitz et al. |
| 2006/0032496 | A1 | 2/2006 | Hale et al. |
| 2006/0032501 | A1 | 2/2006 | Hale et al. |
| 2006/0120962 | A1 | 6/2006 | Rabinowitz et al. |
| 2006/0153779 | A1 | 7/2006 | Rabinowitz et al. |
| 2006/0177382 | A1 | 8/2006 | Rabinowitz et al. |
| 2006/0193788 | A1 | 8/2006 | Hale et al. |
| 2006/0216243 | A1 | 9/2006 | Rabinowitz et al. |
| 2006/0216244 | A1 | 9/2006 | Rabinowitz et al. |
| 2006/0233717 | A1 | 10/2006 | Hale et al. |
| 2006/0233718 | A1 | 10/2006 | Rabinowitz et al. |
| 2006/0233719 | A1 | 10/2006 | Rabinowitz et al. |
| 2006/0239936 | A1 | 10/2006 | Rabinowitz et al. |
| 2006/0246011 | A1 | 11/2006 | Rabinowitz et al. |
| 2006/0246012 | A1 | 11/2006 | Rabinowitz et al. |
| 2006/0247573 | A1 | 11/2006 | Alexandre et a. |
| 2006/0251587 | A1 | 11/2006 | Rabinowitz et al. |
| 2006/0251588 | A1 | 11/2006 | Rabinowitz et al. |
| 2006/0257328 | A1 | 11/2006 | Rabinowitz et al. |
| 2006/0257329 | A1 | 11/2006 | Rabinowitz et al. |
| 2006/0269486 | A1 | 11/2006 | Rabinowitz et al. |
| 2006/0269487 | A1 | 11/2006 | Rabinowitz et al. |
| 2006/0280692 | A1 | 12/2006 | Rabinowitz et al. |
| 2006/0286042 | A1 | 12/2006 | Rabinowitz et al. |
| 2006/0286043 | A1 | 12/2006 | Rabinowitz et al. |
| 2007/0014737 | A1 | 1/2007 | Rabinowitz et al. |
| 2007/0031340 | A1 | 2/2007 | Hale et al. |

FOREIGN PATENT DOCUMENTS

| | | | |
|---|---|---|---|
| DE | 26 48 308 | | 4/1978 |
| DE | 35 42 447 | | 6/1987 |
| DE | 195 46 341 | | 1/1997 |
| DE | 195 46 431 | | 1/1997 |
| DE | 196 16 627 | | 11/1997 |
| EP | 0 244 837 | | 11/1987 |
| EP | 0 279 796 | | 8/1988 |
| EP | 0 297 796 | | 8/1988 |
| EP | 0 363 494 | | 4/1990 |
| EP | 1 325 761 | | 10/1995 |
| EP | 0 780 659 | | 6/1997 |
| EP | 0 816 674 | A1 | 1/1998 |
| EP | 0 936 205 | | 8/1999 |
| EP | 1 065 296 | | 1/2001 |
| EP | 1 079 002 | | 2/2001 |
| EP | 1 345 268 | A2 | 9/2003 |
| FR | 1 289 468 | | 4/1962 |
| FR | 2 234 532 | | 1/1975 |
| FR | 2 506 927 | | 12/1982 |
| GB | 1 001 901 | | 8/1965 |
| GB | 2 049 651 | | 12/1980 |
| GB | 2 123 948 | | 2/1984 |
| JP | 57 078968 | | 5/1982 |
| WO | WO 01/069136 | | 9/2001 |
| WO | WO 02/094242 | | 11/2002 |
| WO | WO 03/021158 | | 3/2003 |
| WO | WO 03/095012 | | 11/2003 |
| WO | WO 2004/011396 | | 2/2004 |
| WO | WO 2004/011396 | A2 | 2/2004 |
| WO | WO 04/050139 | | 6/2004 |
| WO | WO 2004/104490 | | 12/2004 |
| WO | WO 2004/104491 | | 12/2004 |
| WO | WO 2004/104492 | | 12/2004 |
| WO | WO 2004/104493 | | 12/2004 |
| WO | WO 2004/106268 | | 12/2004 |

OTHER PUBLICATIONS

U.S. Appl. No. 10/850,895, filed May 20, 2004, Hale et al.
U.S. Appl. No. 10/851,429, filed May 20, 2004, Hale et al.
U.S. Appl. No. 10/851,883, filed May 20, 2004, Hale et al.
U.S. Appl. No. 10/851,432, filed May 20, 2004, Hale et al.
U.S. Appl. No. 10/861,554, filed Jun. 3, 2004, Cross et al.
Kreith, Frank et al. "Boundary-Layer Fundamentals" Principles of Heat Transfer. Section 4.3: pp. 236-242.
Leaver, T.R. (Nov. 9, 1994) "Interim Defence Standard: Composition SR 58" Ministry of Defence. Vo. 13-159/Issue 1.
Love, C.M. "Development of a Titanium/Boron Blending Process." pp. 37-44.
McCarthy, D.K., et al. (May 1985) "Burn Front Velocity as a function of Pellet Density in Iron/Potassium Perchlorate Heat Powders" Sandia Report.
Merzhanov, Alexander G., (Aug. 19, 1994) "Pyrotechnical Aspects of Self-Propogating High-Temperature Synthesis" Russian Academy of Sciences: International Pyrotechnics Seminar Colorado Springs, US Jul. 25-29, 1994.
Roux, Gillard M. "Laser Diode Ignition of the Combustion of Pyrotechnic Mixtures. Experimental study of the ignition of Zr/KCl04 and Zr/PhCr04".
Office Action mailed May 3, 2006 for U.S. Appl. No. 10/851,432 (filed May 20, 2004).
Office Action mailed May 9, 2006 for U.S. Appl. No. 10/851,429 (filed May 20, 2004).
Office Action mailed May 10, 2006 for U.S. Appl. No. 10/851,883 (filed May 20, 2004).
U.S. Appl. No. 11/504,419, filed Aug. 15, 2006, Hale et al.
Office Action dated Jan. 22, 2007 for U.S. Appl. No 10/851,429.
Office Action dated Jan. 30, 2007 for U.S. Appl. No. 10/851,432.
Office Action dated Jan. 24, 2007 for U.S. Appl. No. 10/851,883.

Office Action mailed Mar. 5, 2007 for U.S. Appl. No. 10/917,735.
U.S. Appl. No. 11/621,397, filed Jan. 9, 2007, Rabinowitz et al.
U.S. Appl. No. 11/670,892, filed Feb. 2, 2007, Every et al.
U.S. Appl. No. 11/687,466, filed Mar. 16, 2007, Zaffaroni et al.

* cited by examiner

STABLE INITIATOR COMPOSITIONS AND IGNITERS

This invention was made with Government support under Grant No. R44 NS044800, awarded by the National Institutes of Health. The Government has certain rights in the invention.

FIELD

This disclosure relates to low gas emitting initiator compositions and plume directed igniters, especially to initiator compositions and igniters employed in enclosed heating units for heating solid fuel.

INTRODUCTION

Self-contained heat units are employed in a wide-range of industries, from food industries for heating food and drink, to outdoor recreation industries for providing hand and foot warmers, to medical applications for inhalation devices. These self-contained heating units can be heated by a variety of mechanisms including an exothermic chemical reaction. Chemically based heating units can include a solid fuel which is capable of undergoing an exothermic metal oxidation-reduction reaction within an enclosure, such as those is described in, for example, U.S. application entitled "Self-Contained Heating Unit and Drug-Supply Unit Employing Same" filed May 20, 2004 (the entire content of which is expressly incorporated herein by reference for all purposes).

A solid fuel can be ignited to generate a self-sustaining oxidation-reduction reaction. Once a portion of the solid fuel is ignited, the heat generated by the oxidation-reduction reaction can ignite adjacent unburned fuel until all of the fuel is consumed in the process of the chemical reaction. The exothermic oxidation-reduction reaction can be initiated by the application of energy to at least a portion of the solid fuel. Energy absorbed by the solid fuel or by an element in contact with the solid fuel can be converted to heat. When the solid fuel becomes heated to a temperature above the auto-ignition temperature of the reactants, e.g. the minimum temperature required to initiate or cause self-sustaining combustion in the absence of a combustion source or flame, the oxidation-reduction reaction will initiate, igniting the solid fuel in a self-sustaining reaction until the fuel is consumed.

Energy can be applied to ignite the solid fuel using a number of methods. For example, a resistive heating element can be positioned in thermal contact with the solid fuel, which when a current is applied, can heat the solid fuel to the auto-ignition temperature. An electromagnetic radiation source can be directed at the solid fuel, which when absorbed, can heat the solid fuel to its auto-ignition temperature. An electromagnetic source can include lasers, diodes, flashlamps and microwave sources. RF or induction heating can heat the solid fuel source by applying an alternating RF field that can be absorbed by materials having high magnetic permeability, either within the solid fuel, or in thermal contact with the solid fuel. The source of energy can be focused onto the absorbing material to increase the energy density to produce a higher local temperature and thereby facilitate ignition. In certain embodiments, the solid fuel can be ignited by percussive forces.

The auto-ignition temperature of a solid fuel comprising a metal reducing agent and a metal-containing oxidizing agent as disclosed in U.S. application entitled "Self-Contained Heating Unit and Drug-Supply Unit Employing Same" filed May 20, 2004 can range from 400° C. to 500° C. While such high auto-ignition temperatures facilitate safe processing and safe use of the solid fuel under many use conditions, for example, as a portable medical device, for the same reasons, to achieve such high temperatures, a large amount of energy must be applied to the solid fuel to initiate the self-sustaining reaction. Furthermore, the thermal mass represented by the solid fuel can require that an impractically high temperature be applied to raise the temperature of the solid fuel above the auto-ignition temperature. As heat is being applied to the solid fuel and/or a support on which the solid fuel is disposed, heat is also being conducted away. Directly heating a solid fuel can require a substantial amount of power due to the thermal mass of the solid fuel and support.

As is well known in the art, for example, in the pyrotechnic industry, sparks can be used to safely and efficiently ignite fuel compositions. Sparks refer to an electrical breakdown of a dielectric medium or the ejection of burning particles. In the first sense, an electrical breakdown can be produced, for example, between separated electrodes to which a voltage is applied. Sparks can also be produced by ionizing compounds in an intense laser radiation field. Examples of burning particles include those produced by friction and break sparks produced by intermittent electrical current. Sparks of sufficient energy incident on a solid fuel can initiate the self-sustaining oxidation-reduction reaction.

Typically, initiator compositions used for actuating devices containing solid fuel, especially, in the field of pyrotechnics, contain lead compounds. Lead compounds in the initiator composition are used because they impart to the composition high thermal stability and are able to initiate reliably by a very low energy stimulus, such as a spark or resistive heating. Recently, igniters having an initiator composition without lead have been described. For example, WO 2004/011396 to Naud et al. describes an electric match that uses nanoparticulates of an energetic material and a binder. However, the initiator composition used for the electric match described in Naud et al. and others used for such purposes, typically contain multiple layers of different materials to provide the desired spark sensitivity, spark intensity, and strength that is required. Additionally, most current commercial electric match compositions contain explosive materials, e.g., nitrocellulose. Also, these materials tend to generate significant amounts of gas upon ignition.

The igniter on which these initiator compositions are placed generally consist of an electrically insulating substrate with copper foil cladding. The size of the substrate is generally approximately 0.4 inches long by 0.1 inches wide and 30 mils thick. The tip of the match has a small diameter Nichrome wire soldered across the edge of the match. Insulating wire leads soldered at the base of the match provide the means of electrically firing the Nichrome wire to produce the initiating spark. The spark plume generated from such an igniter is typically flame shaped and directed one-way such as a flame on a match.

The aforementioned initiator compositions and igniters are capable of generating a high sparking plume. However, there remains a need for initiator compositions that are not only high sparking, but also low gas emitting for enclosed systems and which do not contain explosive material as classified by the Department of Transportation for use in medical, food, and other such devices. Additionally, there is a need for igniters that provide bidirectional plumes.

SUMMARY

Accordingly, it is an object of the invention to provide initiator compositions that are capable of producing high sparks, but are low gas emitters and have defined amounts of power. It is desirable also that these compositions are such that they can be ignited by electrical resistive, percussive, and/or optical ignition.

It is another object of the invention to provide for electrically resistive igniters that generate a bidirectional plume upon ignition. In certain embodiments, the igniter is coated with a high sparking initiator composition.

In one aspect, the invention provides for deflagrating initiator compositions for enclosed heating units or other systems where low gas production is desired, comprising a mixture of a metal containing oxidizing agent, at least one metal reducing agent and a binder. The binder is typically non-explosive. The power has been optimized to deliver sufficient energy to ignite solid fuel, but not so strong as to damage the solid fuel surface if it is coated as a thin layer on a surface Another aspect of the invention, provides for igniters, which ignite a fuel with a bidirectional focused spark plume, comprising a support with a hole contained therein, a resistive heating element with initiator composition thereon to cover the hole, positioned across the hole and connected to at least two conductors in contact with the support.

In yet another aspect of the invention, methods for making an igniter with a bidirectional plume are provided.

It is to be understood that both the foregoing general description and the following detailed description are exemplary and explanatory only and are not restrictive of certain embodiments, as claimed.

DESCRIPTION OF VARIOUS EMBODIMENTS

Figure 1:
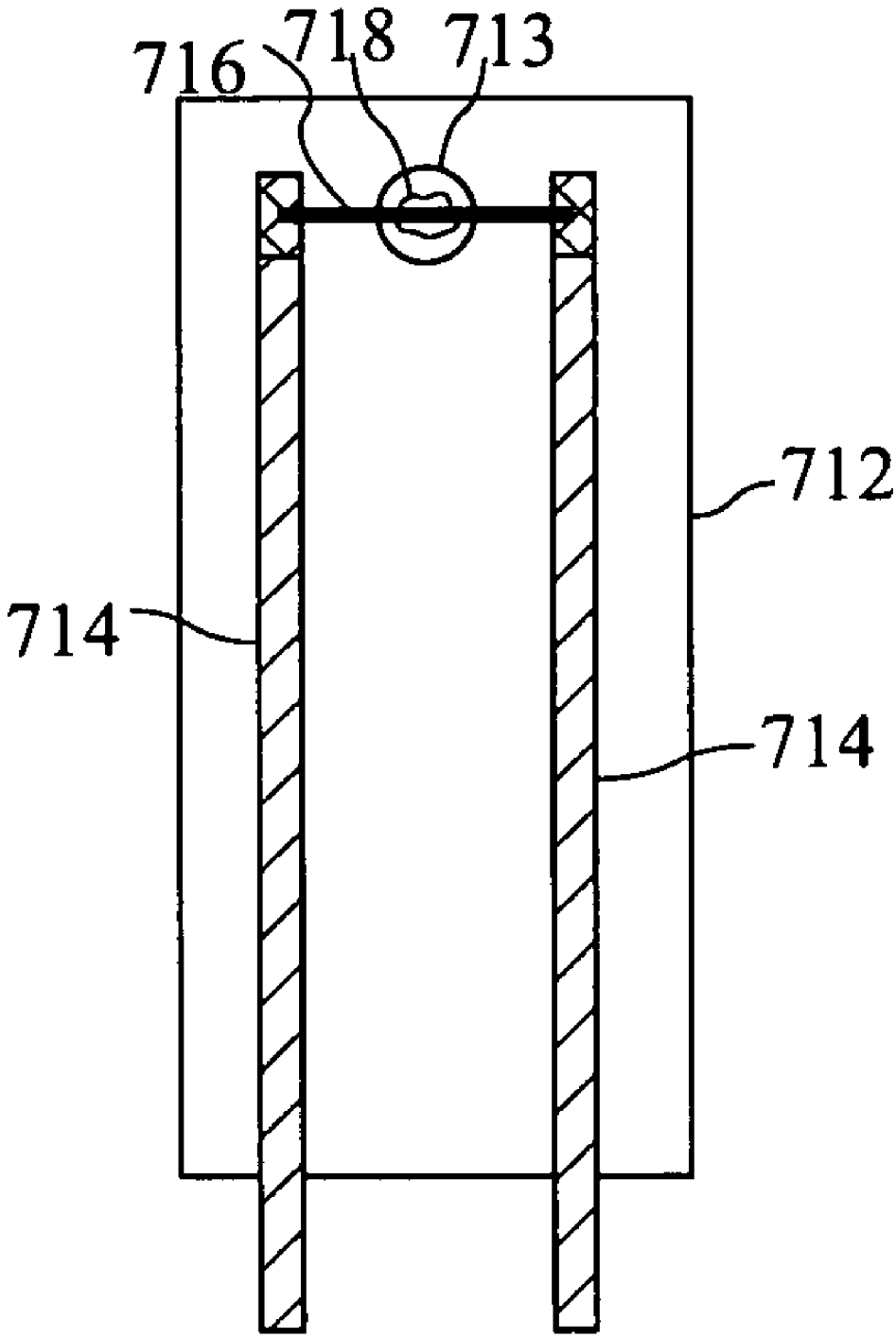
FIG. 1 is a schematic illustration of an igniter comprising an initiator composition disposed on an electrically resistive heating element.

Unless otherwise indicated, all numbers expressing quantities of ingredients, reaction conditions, and so forth used in the specification and claims are to be understood as being modified in all instances by the term "about."

In this application, the use of the singular includes the plural unless specifically stated otherwise. In this application, the use of "or" means "and/or" unless stated otherwise. Furthermore, the use of the term "including," as well as other forms, such as "includes" and "included," is not limiting. Also, terms such as "element" or "component" encompass both elements and components comprising one unit and elements and components that comprise more than one subunit unless specifically stated otherwise.

Initiator Compositions

In order to ignite solid fuel, in particular, fuel coated on a substrate, the igniter should deliver the optimal power to the fuel. If the power released upon igniting the initiator composition is insufficient, the heat delivered to the fuel is dissipated by conduction before the fuel ignites. If the power is too intense, sparks generated from the igniter composition may damage the surface of the coated fuel resulting in non-uniform heating of the surface on which the fuel is coated. In certain applications, such as heating units for delivery of drugs as condensation aerosols, this uniformity of heating can impact the purity of the resultant aerosol. Additionally, it is desirable that these heating units be activated using low voltage if possible, for cost reasons and so that the size of a drug delivery device with a heating unit and batteries can be small.

The initiator compositions of the invention deflagrate and produce an intense spark that readily and reliably ignites solid fuel, but does not damage the surface of the fuel. The initiator compositions are highly reliable and comprise a mixture of a metal containing oxidizer and at least one metal reducing agent.

In certain embodiments, the metal reducing agent can include, but is not limited to molybdenum, magnesium, calcium, strontium, barium, boron, titanium, zirconium, vanadium, niobium, tantalum, chromium, tungsten, manganese, iron, cobalt, nickel, copper, zinc, cadmium, tin, antimony, bismuth, aluminum, and silicon. In certain embodiments, a metal reducing agent can include aluminum, zirconium, and titanium. In certain embodiments, a metal reducing agent can comprise more than one metal reducing agent.

In certain embodiments, an oxidizing agent can comprise oxygen, an oxygen based gas, and/or a solid oxidizing agent. In certain embodiments, an oxidizing agent can comprise a metal-containing oxidizing agent. In certain embodiments, a metal-containing oxidizing agent includes, but is not limited to, perchlorates and transition metal oxides. Perchlorates can include perchlorates of alkali metals or alkaline earth metals, such as but not limited to, potassium perchlorate ($KClO_4$), potassium chlorate ($KClO_3$), lithium perchlorate ($LiClO_4$), sodium perchlorate ($NaClO_4$), and magnesium perchlorate [$Mg(ClO_4)_2$]. In certain embodiments, transition metal oxides that function as oxidizing agents include, but are not limited to, oxides of molybdenum (such as $MoO_3$), iron (such as $Fe_2O_3$), vanadium ($V_2O_5$), chromium ($CrO_3$, $Cr_2O_3$), manganese ($MnO_2$), cobalt ($Co_3O_4$), silver ($Ag_2O$), copper ($CuO$), tungsten ($WO_3$), magnesium ($MgO$), and niobium ($Nb_2O_5$). In certain embodiments, the metal-containing oxidizing agent can include more than one metal-containing oxidizing agent.

In certain embodiments, the metal reducing agent and the oxidizing agent can be in the form of a powder. The term "powder" refers to powders, particles, prills, flakes, and any other particulate that exhibits an appropriate size and/or surface area to sustain self-propagating ignition. For example, in certain embodiments, the powder can comprise particles exhibiting an average diameter ranging from 0.01 μm to 200 μm.

In certain embodiments, the amount of oxidizing agent in the initiator composition can be related to the molar amount of the oxidizers at or near the eutectic point for the fuel composition. In certain embodiments, the oxidizing agent can be the major component and in others the metal reducing agent can be the major component. Also as known in the art, the particle size of the metal and the metal-containing oxidizer can be varied to determine the burn rate, with smaller particle sizes selected for a faster burn (see, for example, PCT WO 2004/01396). Thus, in some embodiments where faster burn is desired, it is preferable that the particles be nanosize.

In certain embodiments, the amount of metal reducing agent can range from 25% by weight to 75% by weight of the total dry weight of the initiator composition. In certain embodiments, the amount of metal-containing oxidizing agent can range from 25% by weight to 75% by weight of the total dry weight of the initiator composition.

In certain embodiments, an initiator composition can comprise at least one metal, such as those described herein, and at least one oxidizing agent, such as, for example, a chlorate or perchlorate of an alkali metal or an alkaline earth metal or metal oxide and others disclosed herein.

In certain embodiments, the initiator composition can comprise at least one metal reducing agent from the group consisting of aluminum, zirconium, and boron. In certain embodiments, the initiator composition can comprise at least one oxidizing agent from the group consisting of molybdenum trioxide, copper oxide, tungsten trioxide, potassium chlorate, and potassium perchlorate.

In certain embodiments, where ease of handling is preferred, aluminum is a preferred metal reducing agent. Aluminum has several advantages including that it can be obtained in various sizes, such as nanoparticles, and it readily forms a protective oxide-layer. Thus, it can be purchased and handled in a dry state. Additionally, as it is less pyrophoric than other metal reducing agents, such as, for example, zirconium, it can be handled with greater safety.

In certain embodiments, the composition can comprise more than one metal reducing agent. In such compositions, at least one of the reducing agents is preferably boron. Boron has been used in other initiator compositions (see, e.g., U.S. Pat. Nos. 4,484,960 and 5,672,843). Boron enhances the speed at which initiation occurs to provide more heat output in the presence of oxidants.

In certain embodiments, reliable, reproducible and controlled ignition of the solid fuel can be facilitated by the use of an initiator composition comprising a mixture of a metal containing oxidizing agent, at least one metal reducing agent and at least one binder and/or additive material such as a gelling agent and/or binder. The initiator composition can comprise the same or similar reactants as those comprising the solid fuel In certain embodiments, an initiator composition can comprise additive materials to facilitate, for example, processing, enhance the mechanical integrity and/or determine the burn and spark generating characteristics. An inert additive material will not react or will react to a minimal extent during ignition and burning of the initiator composition. This is particularly advantageous when working with an enclosed system, wherein minimization of gas build-up is desired. The additive materials can be inorganic materials and can function as binders, adhesives, gelling agents, thixotropic, and/or surfactants. Examples of gelling agents include, but are not limited to, clays such as Laponite®, Montmorillonite, Cloisite®, metal alkoxides such as those represented by the formula R—$Si(OR)_n$ and $M(OR)_n$ where n can be 3 or 4, and M can be Ti, Zr, Al, B or other metals, and collidal particles based on transition metal hydroxides or oxides. Examples of binding agents include, but are not limited to, soluble silicates such as Na- or K-silicates, aluminum silicates, metal alkoxides, inorganic polyanions, inorganic polycations, inorganic sol-gel materials such as alumina or silica-based sols. Other useful additive materials include glass beads, diatomaceous earth, nitrocellulose, polyvinylalcohol, guar gum, ethyl cellulose, cellulose acetate, polyvinylpyrrolidone, fluoro-carbon rubber (Viton) and other polymers that can function as a binder. In certain embodiments, the initiator composition can comprise more than one additive material.

In certain embodiments, additive materials can be useful in determining certain processing, ignition, and/or burn characteristics of the initiator composition. In certain embodiments, the particle size of the components of the initiator can be selected to tailor the ignition and burn rate characteristics as is known in the art (see for example U.S. Pat. No. 5,739,460).

In certain embodiments, it is desirable that the additives be inert. When sealed within an enclosure, the exothermic oxidation-reduction reaction of the initiator composition can generate an increase in pressure depending on the components selected. In certain applications, such as in portable medical devices, it can be useful to contain the pyrothermic materials and products of the exothermic reaction and other chemical reactions resulting from the high temperatures within the enclosure. While containing the exothermic reaction can be accomplished by adequately sealing the enclosure to withstand the internal pressures resulting from the burning of the solid fuel as well as an initiator composition, it can be useful to minimize the internal pressure to ensure the safety of the heating device and facilitate device fabrication. Another means is to minimize the amount of gas phase reaction products produced by the initiator composition during ignition and burn. Thus, in certain embodiments, the pressure within the substrate can be managed by minimizing the amount of initiator composition used for ignition of the solid fuel. Also, the pressure can be managed by the selection of additive materials that are inert and/or less likely to form large quantities of gases upon ignition.

In more preferred embodiments, particularly those where the heating unit is used in medical applications it is desirable that the additive not be an explosive, as classified by the U.S. Department of Transportation, such as, for example, nitrocellulose. In preferred embodiments, the additives are Viton® and Laponite®. These materials bind to the other initiator components and provide good mechanical stability to the initiator composition.

The components of the initiator composition comprising the metal, metal-containing oxidizing agent and/or additive material and/or any appropriate aqueous- or organic-soluble binder, can be mixed by any appropriate physical or mechanical method to achieve a useful level of dispersion and/or homogeneity. For ease of handling, use and/or coating, the initiator compositions can be prepared as liquid suspensions or slurries in an organic or aqueous solvent.

The ratio of metal reducing agent to metal-containing oxidizing agent can be selected to determine the appropriate burn and spark generating characteristics. In certain embodiments, the initiator composition can be formulated to maximize the production of sparks having sufficient energy to ignite a solid fuel. Sparks ejected from an initiator composition can impinge upon the surface of the solid fuel, causing the solid fuel to ignite in a self-sustaining exothermic oxidation-reduction reaction. In certain embodiments, the total amount of energy released by the initiator compositions ranged between 0.25 J and 8.5 J upon actuation of the compositions. These compositions burn with a deflagration time of between about 5 milliseconds to 30 milliseconds at a composition thickness of about 20 microns to 100 microns. In certain embodiments, the deflagration time for the compositions is in the range from about 5 milliseconds to 20 milliseconds at a composition thickness of about 40 to 100 microns. In other embodiments, the deflagration time is in the range of about 5 to 10 milliseconds at a composition thickness of about 40 to 80 microns.

Figure 2:
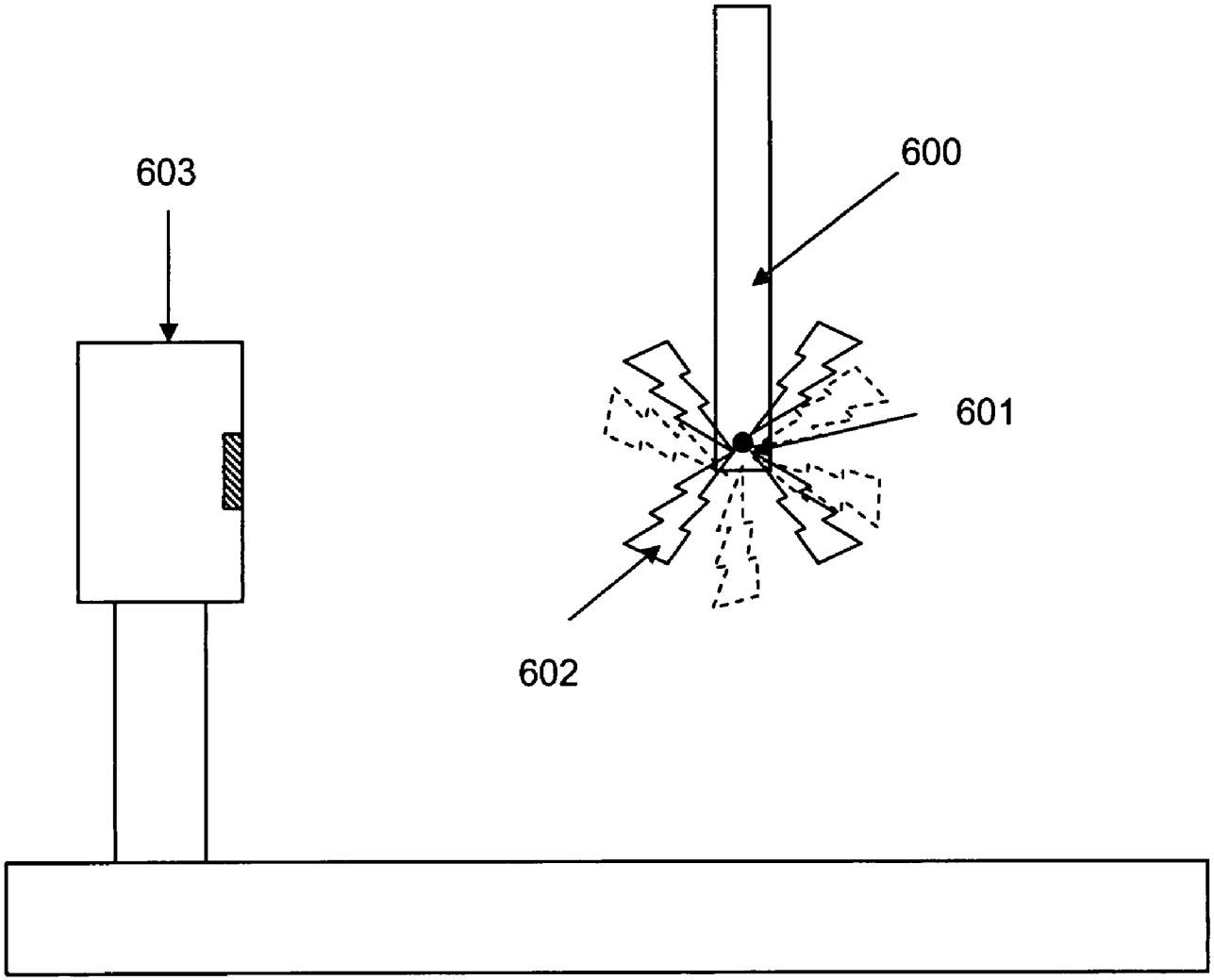
FIG. 2 is a schematic illustration of the photodetector system used to measure light intensity of the igniters and initiator compositions.

The energy of the initiator composition can be measured by mass of starter dispensed for a given formulation if the initiator composition reaction goes to completion. The correlation between the power and energy generated by the initiator composition is determined by the chemical composition of the initiator composition and the physical configuration of the compositions, such as, for example, thickness per mass. One way of measuring the power of an initiator composition is to monitor the intensity of light from the sparks generated. The light intensity is a function of the number density of the sparks, the temperature of the sparks and the chemical and physical properties of the sparks. As the properties of the sparks are determined by the initiator's chemical composition, the assumption is the power correlates to higher numbers and hotter temperatures associated with the sparks. Example 3 describes a method used for measuring light intensity. The method is depicted in FIG. 2. As shown in FIG. 2, an initiator composition 601 coated on an igniter 600 was actuated using two A76 batteries, 3.13V (not shown). Upon actuation, sparks 602 were released and the photo detector 603 was used to measure the light intensity. The intensity versus time recording is done using an oscilloscope. The voltage output signal from the photo detector 603 is proportional to light intensity at a given wavelength. The energy of the starter can also be measured by integrating the area under the curve, as energy=power×time. Those of skill in the art are able to determine the appropriate amount of each component based on the stoichiometry of the chemical reaction and the known limitations of energy desired, and/or by routine experimentation. The power has been optimized to deliver sufficient energy to ignite solid fuel, but not so strong as to damage the solid fuel surface if it is coated as a thin layer on a surface.

Figure 3A:
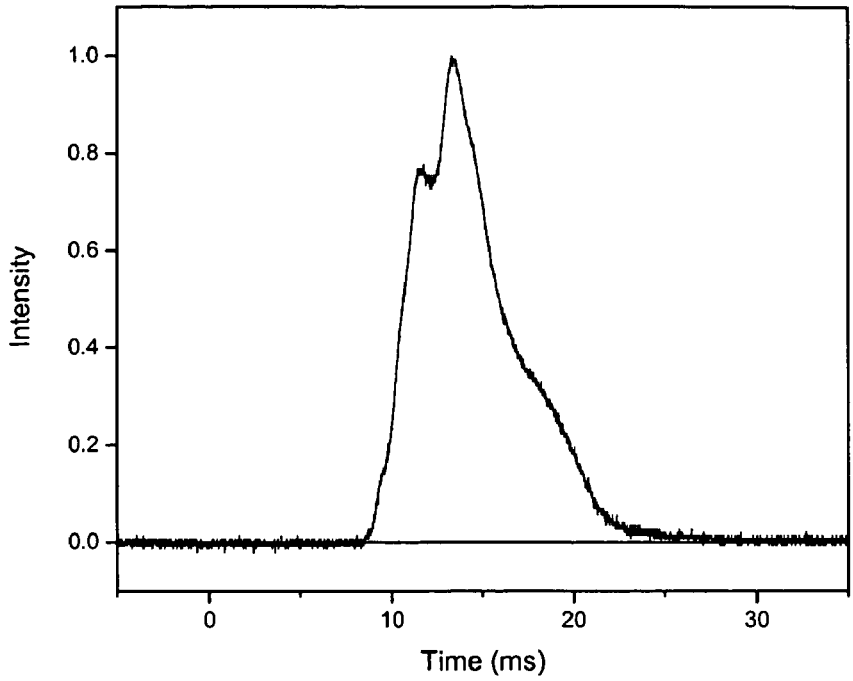
FIGS. 3A–3B are graphs of light intensity versus time for two different compositions mixtures.
Figure 3B:
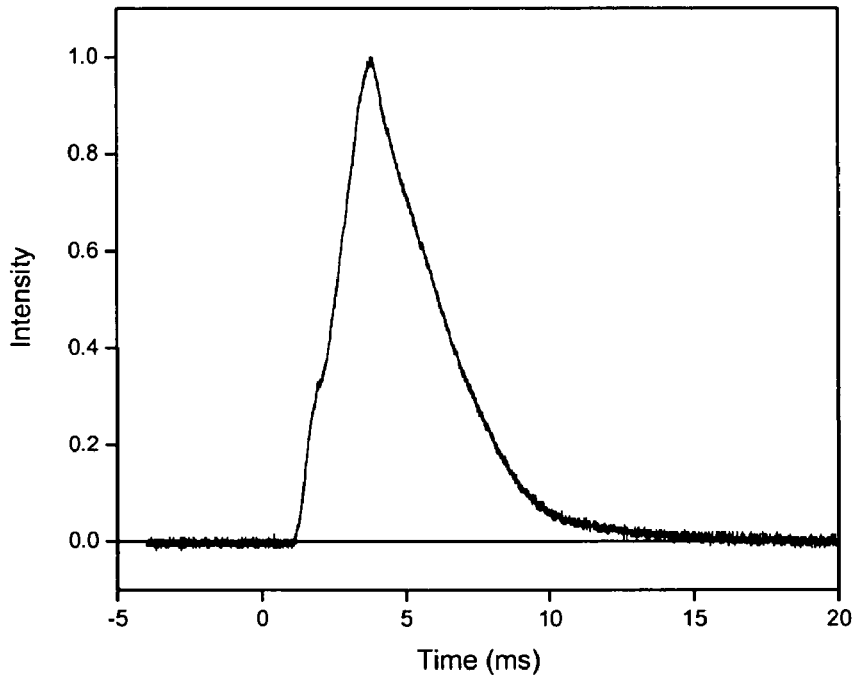

FIGS. 3A & 3B are measurements of the intensity of two initiator compositions versus time. The intensity was measured by recording the voltage from a photo detector and FIG. 3A shows the results with 0.4 μL nanoZr:nanoMoO$_3$ (50:50) and 1 μL nanoZr:micro MoO$_3$ (50:50), with nitrocellulose binder on a 0.0008 inch thick Nichrome wire. The deflagration time is about 15 milliseconds. FIG. 3B shows the results with 1.9 μL of a mixture of 26.5% Al, 51.5% MoO$_3$, 7.8% B and 14.2% Viton A500 (dry weight percent) on a 0.0008 inch thick Nichrome wire. The deflagration time is about 10 milliseconds.

In certain embodiments, such as those where a solid fuel is coated on a substrate, it is desirable that the uniform or nearly uniform thickness of the solid fuel coating not be modified or damaged upon impact of sparks from the initiator compositions, as the thickness of the thin layer of solid fuel and the composition of solid fuel can determine the maximum temperature as well as the temporal and spatial dynamics of the temperature profile produced by the burning of the solid fuel. Studies using thin solid fuel layers having a thickness ranging from 0.001 inches to 0.005 inches have shown that the maximum temperature reached by a substrate on which the solid fuel is disposed depends on the thickness of the layer as well as the composition of the fuel constituents. Thus, maintaining uniformity of the solid fuel layer is necessary to achieving uniformity of temperature across that region of the substrate on which the solid fuel is disposed. In certain applications, such as, for example, uniform heating of the substrate can facilitate the production of an aerosol comprising a high purity of a drug or pharmaceutical composition and maximize the yield of aerosol from the drug initially deposited on the substrate forming. The compositions of the invention are such that they prevent or minimize damage from sparks impinging on a fuel coating. The initiator compositions of the invention produce sufficient power to ignite a solid fuel from a distance of between about 0.05–1.5 inches without damaging the surface area, in a manner that impacts the uniformity of temperature of the surface area. In certain embodiments, the initiator composition can be placed directly on the fuel compositions itself without impacting the uniformity of temperature of the surface area upon ignition of the fuel.

Examples of certain initiator compositions of the invention include compositions comprising 10% Zr:22.5% B:67.5% KClO$_3$; 49.)% Zr:49.0% MoO$_3$ and 2.0% nitrocellulose, and 33.9% Al:55.4% MoO$_3$:8.9% B:1.8 nitrocellulose; 26.5% Al:51.5% MoO$_3$:7.8% B:14.2% Viton; 47.6% Zr:47.6% MoO$_3$:4.8% Laponite in dry weight percent.

A particularly high-sparking and low gas producing initiator composition of the invention comprises a mixture of aluminum, molybdenum trioxide, boron and Viton. In certain embodiments, these components are combined in a mixture based on dry weight of 20–30% aluminum, 40–55% molybdenum trioxide, 6–15% boron, and 5–20% Viton. In certain embodiments, the compositions comprises 26–27% aluminum, 51–52% molybdenum trioxide, 7–8% boron, and 14–15% Viton. In more preferred embodiments, the aluminum, boron, and molybdenum trioxide comprise nanosized particles. In other embodiments, the Viton is Viton A500.

Examples 1 and 2 describe representative examples of preparation of initiator compositions of the invention.

The initiator composition can be placed directly on the fuel itself and ignited by a variety of means, including, for example, optical or percussive. Alternatively, the initiator composition can be applied to an igniter such as is shown in FIG. 1. The igniter can comprise a physically small, thermally isolated heating element attached to a support.

Energy sufficient to heat the initiator composition to the auto-ignition temperature can be applied to the initiator composition and/or the support on which the initiator composition is disposed. In certain embodiments, the ignition temperature of initiator composition can range from 200° C. to 500° C. The energy source can be any of those disclosed herein, such as resistive heating, radiation heating, inductive heating, optical heating, and percussive heating. In certain embodiments, it is desirable that these initiator compositions be activated using low voltage if possible, for cost reasons and when a small device containing the heating unit and the actuation system is desired. In certain applications, for example, with battery powered portable medical devices, such considerations can be particularly useful. In certain embodiments, it can be useful that the energy source be one or more small low cost batteries, such as, for example, a 1.5 V alkaline battery or a LR 44 battery.

Igniters

In another aspect of the invention, novel igniters comprising electrically resistive materials are disclosed. These igniters, by proper placement of an electrically resistive element on a support with a hole in it, generate bidirectional focused plumes. This allows the power dissipated from the igniter by sparking to be directed to two solid fuel coated surfaces of an enclosed heating unit simultaneously, thereby igniting both surfaces.

In one embodiment, the igniter comprises a support with a hole contained therein and at least two conductors in contact with the support, a resistive heating element positioned at least partially across the hole and attached to the conductors and an initiator composition placed on at least a portion of both sides of the resistive heating element and covering the hole.

The electrically resistive material also referred to herein as a resistive heating element, can comprise a material capable of generating heat when electrical current is applied. The electrically resistive heating element can comprise any material that can maintain integrity at the auto-ignition temperature of the igniter composition.

In certain embodiments, the heating element can comprise an elemental metal such as tungsten, an alloy such as Nichrome, or other material such as carbon. Materials suitable for resistive heating elements are known in the art.

In order to get reliable and consistent ignition, the time of ignition delay should be short and reproducible. The ignition time delay is a function of rate of temperature rise of the electrically resistive heating element and the ignition temperature of the starter fuel material, as shown by the equation below.

$$f(t_{ignition\ delay}) = f\left(\frac{dT}{dt_x}, T_{starter\ fuel\ material\ ignition}\right) \quad [1]$$

where x refers to the electrically resistive heating element

Thus, the faster the electrically resistive heating element heats up, the earlier the igniter will ignite. Assuming that the electrically resistive heating element heats up adiabatically, the heating rate of the electrically resistive heating element can be calculated thermodynamically as follows:

$$\frac{dT}{dt_x} = \frac{I^2}{A_c^2}\left(\frac{\rho_E}{\rho c}\right) \quad [2]$$

where X refers to the electrically resistive heating element

I is the current passing through bridgewire, $A_c$ is the cross-sectional area of the bridgewire $\rho_E$ is the electric resistivity, $\rho$ is the density, and c is the specific heat.

If the current is limited, such as is the case when using a battery to ignite the igniter, a larger $\rho_E/(\rho\ c)$ with a lower cross-sectional area will result in increasing heating rate. Thus, in certain embodiments, electrically resistive heating elements having a large $\rho_E/(\rho\ c)$ are used. In certain embodiments, Nichrome is used as it has a large $\rho_E/(\rho\ c)$ of $3.92\times 10^{-13}\ \Omega m^4 K/J$, in addition to a high melting point, 1672° K.

In certain embodiments, it is preferable also that the electrically resistive heating element also be chemically inert or corrosion resistant and solder or weld readily to form an electric connection.

The resistive heating element can have any appropriate form. For example, the resistive heating element can be in the form of a wire, filament, ribbon or foil. However, the dimensions of the resistive heating element can impact the ignition. The selection of the dimension of the resistive heating element can be governed by the system to which it will be applied. In certain embodiments, the resistive heating element is a wire having a diameter of less than about 0.001 inches, in others less than about 0.0008 inches and in still others, less than about 0.0006 inches.

The appropriate selection of the resistivity of the heating element can at least in part be determined by the current of the power source, the desired auto ignition temperature, or the desired ignition time. If a battery is used, in order to deliver maximum power to the electrically resistive heating element, resistance of the electrically resistive heating element should be the same as the internal resistance of the battery. Thus, in certain embodiments where two batteries such as LR44 or equivalent are used to actuate the igniter, which deliver about 1.5V each with an internal resistance of 2 ohms and a maximum current of 0.5 Amps per battery, the electrically resistive heating element resistance should also be about 4 ohms. In certain embodiments, the electrical resistance of the heating element can range from 2 Ω to 4 Ω.

Once a wire diameter is determined, the length of the wire is automatically fixed by the given resistance of the resistive heating element. Thus, for example, if the electrical resistive heating element is a Nichrome wire with a 0.0008 inch diameter to be powered by two 1.5V, LR44 button batteries, then the length of the wire should be about 0.030 inches to give a resistance of about 3 ohms, which is close to the internal resistance of the batteries used.

The electrically resistive heating element can be connected to electrical conductors. The heating element can be soldered or electrically connected to conductors, such as, Cu conductors or graphite/silver ink traces, disposed on a support. The support can be an electrically insulating substrate, such as a polyimide, polyester, or fluoropolymer. The conductors can be disposed between two opposing layers of an electrically insulating material such as flexible or rigid printed circuit board materials. In certain embodiments, the support can be thermally isolated to minimize the potential for heat loss. In this way, dissipation of thermal energy applied to the combination of assembly and support can be minimized, thereby reducing the power requirements of the energy source, and facilitating the use of physically smaller and less expensive heat sources.

The support has a hole or opening contained therein. The resistive heating element is disposed at least partially over the hole. With only one resistive heating element in the igniter, in order to generate bi-directional plumes or sparks, a hole is necessary to allow the sparks to generate from the side of the support where the resistive heating element is attached to the other side. This allows for ignition of solid fuel that is in contact with the sparks coming from either side of the igniter. In certain embodiments, the diameter of the hole in the support is determined by the length of the resistive heating element.

An initiator composition, such as those disclosed herein, can be disposed on the surface of the electrically resistive material such that when the electrically resistive material is heated to the ignition temperature of the initiator composition, the initiator composition can ignite to produce sparks. An initiator composition can be applied to the electrically resistive heating element by depositing a slurry comprising the initiator composition and drying. In certain embodiments, the auto-ignition temperature of the initiator composition can range from 200° C. to 500° C.

The resistive heating element can be electrically connected, and suspended between two electrodes electrically connected to a power source. If the power source is a battery, in order to increase the reliability of the ignition of the system, a capacitor can be added. The capacitor facilitates delivery of additional energy early during the heating to the electrically resistive heating element by discharging the energy stored in the capacitor, resulting in shorter igniting delays and less misfires. In certain embodiments, where the igniter is used in a resistively actuated heating unit, a capacitor is added the power system.

In certain embodiments, the onset of deflagration occurred in less than 20 milliseconds upon actuation of the igniter; in others, onset of deflagration occurred in less than 10 milliseconds; in still others, the onset of deflagration occurred in less than 6 milliseconds; and in yet others, the onset of deflagration occurred in 1 millisecond or less upon actuation of the igniter.

An embodiment of an igniter of the invention comprising a resistive heating element is illustrated in FIG. 1. As shown in FIG. 1, resistive heating element 716 is electrically connected to electrodes 714. Electrodes 714 can be electrically connected to an external power source such as a battery (not shown). As shown in FIG. 1, electrodes 714 are disposed on a laminate material 712 such as a printed circuit material. Such materials and methods of fabricating such flexible or rigid laminated circuits are well known in the art. In certain embodiments, laminate material 712 can comprise a material that will not degrade at the temperatures reached by resistive heating element 716, by the exothermic reaction including sparks generated by initiator composition 718, and at the temperature reached during burning of the solid fuel. For example, laminate 712 can comprise Kapton®, a fluorocarbon laminate material or FR4 epoxy/fiberglass printed circuit board. Resistive heating element 716 is positioned in an opening 713 in laminate 712. Opening 713 thermally isolates resistive heating element 716 to minimize thermal dissipation and facilitate transfer of the heat generated by the resistive heating element to the initiator composition, and can provide a path for sparks ejected from igniter composition 718 to impinge upon a solid fuel (not shown).

As shown in FIG. 1, initiator composition 718 is disposed on resistive heating element 716.

The following procedure was used to apply the initiator composition to resistive heating elements.

A 0.0008 inch diameter Nichrome wire was soldered to Cu conductors disposed on a 0.005 inch thick FR4 epoxy/fiberglass printed circuit board (Onanon). The dimensions of the igniter printed circuit board were 1.82 inches by 0.25 inches. Conductor leads can extend from the printed circuit board for connection to a power source. In certain embodiments, the electrical leads can be connected to an electrical connector.

The igniter printed circuit board was cleaned by sonicating (Branson 8510R-MT) in DI water for 10 minutes, dried, sprayed with acetone and air dried.

The initiator composition comprised 0.68 grams nano-aluminum (40–70 nm diameter; Argonide Nanomaterial Technologies, Sanford, Fla.), 1.32 grams of nano-$MoO_3$ (EM-NTO-U2; Climax Molybdenum, Henderson, Colo.), and 0.2 grams of nano-boron (33,2445-25G; Aldrich). A slurry comprising the initiator composition was prepared by adding 8.6 mL of 4.25% Viton A500 (4.25 grams Viton in 100 mL amyl acetate (Mallinckrodt)) solution.

A 1.1 uL drop of slurry was deposited on the heating element, dried for 20 minutes, and another 0.8 uL drop of slurry comprising the initiator composition was deposited on the opposite side of the heating element.

Application of 3.0 V through a 1,000 μF capacitor from two A76 alkaline batteries to the Nichrome heating element ignited the Al:$MoO_3$:B initiator composition within 1 to 50 msec, typically within 1 to 6 msec. When positioned within 0.12" inches of the surface of a solid fuel comprising a metal reducing agent and a metal-containing oxidizing agent such as, for example, a fuel comprising 76.16% Zr:19.04% $MoO_3$: 4.8% Laponite® RDS, the sparks produced by the initiator composition ignited the solid fuel to produce a self-sustaining exothermic reaction. In certain embodiments, a 1 μL drop of the slurry comprising the initiator composition can be deposited onto the surface of the solid fuel adjacent the initiator composition disposed on the resistive heating element to facilitate ignition of the solid fuel.

The initiator composition comprising Al:$MoO_3$:B adhered to the Nichrome wire and maintained physical integrity following mechanical and environmental testing including temperature cycling (−25° C.↔40° C.), drop testing, and impact testing. Examples 3–5 further describe some of the testing done with the igniters.

The igniters disclosed herein and/or the initiator compositions disclosed herein can be used to ignite solid fuel in heating units. They have particular application in heating units that are sealed, such as those, for example, described below.

Heating Units Comprising Initiator Compositions and Igniters

Figure 4A:
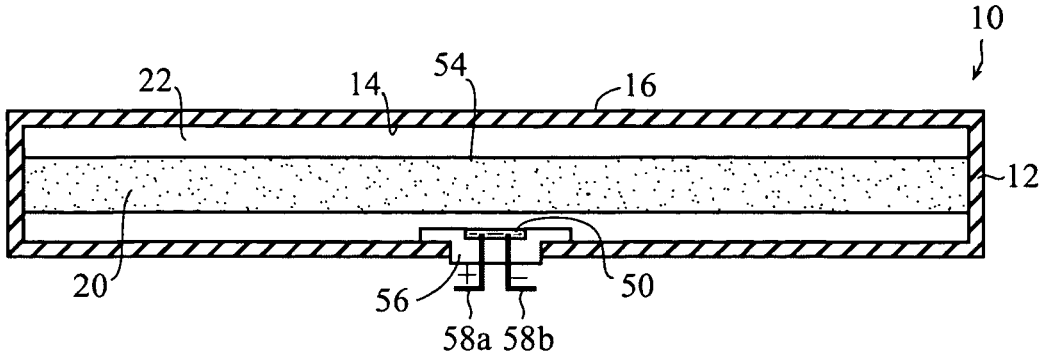
FIGS. 4A–4B are cross-sectional illustrations of heating units according to certain embodiments.
Figure 4B:
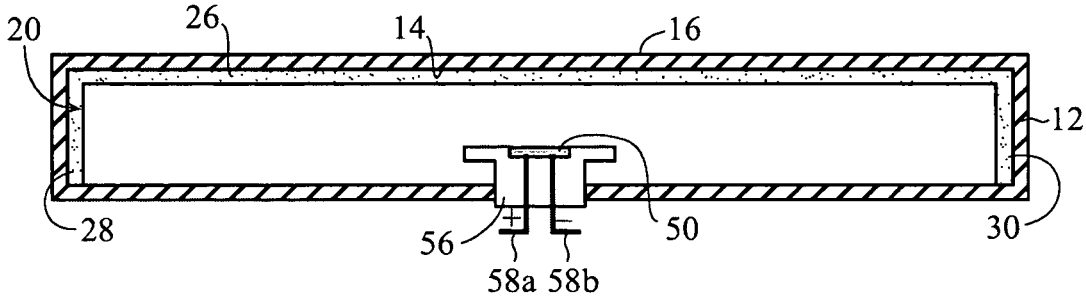

An embodiment of a heating unit in which the initiator compositions of the inventions can be used is shown in FIG. 4A. Heating unit 10 can comprise a substrate 12 which can be formed from a thermally-conductive material. Thermally-conductive materials are well known, and typically include, but are not limited to, metals, such as aluminum, iron, copper, stainless steel, and the like, alloys, ceramics, and filled polymers. The substrate can be formed from one or more such materials and in certain embodiments, can have a multilayer structure. For example, the substrate can comprise one or more films and/or coatings and/or multiple sheets or layers of materials. In certain embodiments, portions of the substrate can be formed from multiple sections. In certain embodiments, the multiple sections forming the substrate of the heating unit can have different thermal properties. A substrate can be of any appropriate geometry, the rectangular configuration shown in FIG. 4A is merely exemplary. A substrate can also have any appropriate thickness and the thickness of the substrate can be different in certain regions. Substrate 12, as shown in FIGS. 4A & 4B, has an interior surface 14 and an exterior surface 16. Heat can be conducted from interior surface 14 to exterior surface 16. An article or object placed adjacent or in contact with exterior surface 16 can receive the conducted heat to achieve a desired action, such as warming or heating a solid or fluid object, effecting a further reaction, or causing a phase change. In certain embodiments, the conducted heat can effect a phase transition in a compound in contact, directly or indirectly, with exterior surface 16.

The heating unit 10 further comprises an expanse of a solid fuel 20. Solid fuel 20 can be adjacent to the interior surface 14, where the term "adjacent" refers to indirect contact as distinguished from "adjoining" which herein refers to direct contact. As shown in FIG. 4A, solid fuel 20 can be adjacent to the interior surface 14 through an intervening open space 22 defined by interior surface 14 and solid fuel 20. In certain embodiments, as shown in FIG. 4B, solid fuel 20 can be in direct contact with or adjoining interior surface 14.

In certain embodiments, the solid fuel can comprise a metal reducing agent and an oxidizing agent, such as for example, a metal-containing oxidizing agent.

In certain embodiments, the metal reducing agent can include, but is not limited to molybdenum, magnesium, calcium, strontium, barium, boron, titanium, zirconium, vanadium, niobium, tantalum, chromium, tungsten, manganese, iron, cobalt, nickel, copper, zinc, cadmium, tin, antimony, bismuth, aluminum, and silicon. In certain embodiments, a metal reducing agent can include aluminum, zirconium, and titanium. In certain embodiments, a metal reducing agent can comprise more than one metal reducing agent.

In certain embodiments, the oxidizing agent can comprise oxygen, an oxygen based gas, and/or a solid oxidizing agent. In certain embodiments, an oxidizing agent can comprise a metal-containing oxidizing agent. In certain embodiments, the metal-containing oxidizing agent includes, but is not limited to, perchlorates and transition metal oxides. Perchlorates can include perchlorates of alkali metals or alkaline earth metals, such as, but not limited to, potassium perchlorate ($KClO_4$), potassium chlorate ($KClO_3$), lithium perchlorate ($LiClO_4$), sodium perchlorate ($NaClO_4$), and magnesium perchlorate [$Mg(ClO_4)_2$]. In certain embodiments, transition metal oxides that function as oxidizing agents include, but are not limited to, oxides of molybdenum (such as $MoO_3$), iron (such as $Fe_2O_3$), vanadium ($V_2O_5$), chromium ($CrO_3$, $Cr_2O_3$), manganese ($MnO_2$), cobalt ($Co_3O_4$), silver ($Ag_2O$), copper (CuO), tungsten ($WO_3$), magnesium (MgO), and niobium ($Nb_2O_5$). In certain embodiments, the metal-containing oxidizing agent can include more than one metal-containing oxidizing agent.

In certain embodiments, the metal reducing agent forming the solid fuel can be selected from zirconium and aluminum, and the metal-containing oxidizing agent can be selected from $MoO_3$ and $Fe_2O_3$.

The ratio of metal reducing agent to metal-containing oxidizing agent can be selected to determine the ignition temperature and the burn characteristics of the solid fuel. An exemplary chemical fuel can comprise 75% zirconium and 25% $MoO_3$, percentage based on weight. In certain embodiments, the amount of metal reducing agent can range from 60% by weight to 90% by weight of the total dry weight of the solid fuel. In certain embodiments, the amount of metal-containing oxidizing agent can range from 10% by weight to 40% by weight of the total dry weight of the solid fuel.

In certain embodiments, a solid fuel can comprise additive materials to facilitate, for example, processing and/or to determine the thermal and temporal characteristics of a heating unit during and following ignition of the solid fuel. An additive material can be organic or inorganic and can function as binders, adhesives, gelling agents, thixotropic agents, and/or surfactants. Examples of gelling agents include, but are not limited to, clays such as Laponite®, Montmorillonite, Cloisite®, metal alkoxides, such as those represented by the formula R—$Si(OR)_n$ and $M(OR)_n$ where n can be 3 or 4, and M can be Ti, Zr, Al, B or other metals, and collidal particles based on transition metal hydroxides or oxides. Examples of binding agents include, but are not limited to, soluble silicates such as Na- or K-silicates, aluminum silicates, metal alkoxides, inorganic polyanions, inorganic polycations, and inorganic sol-gel materials, such as alumina or silica-based sols.

Other useful additive materials include glass beads, diatomaceous earth, nitrocellulose, polyvinylalcohol, and other polymers that may function as binders. In certain embodiments, the solid fuel can comprise more than one additive material. The components of the solid fuel comprising the metal, oxidizing agent and/or additive material and/or any appropriate aqueous- or organic-soluble binder, can be mixed by any appropriate physical or mechanical method to achieve a useful level of dispersion and/or homogeneity. In certain embodiments, the solid fuel can be degassed.

Figure 4C:
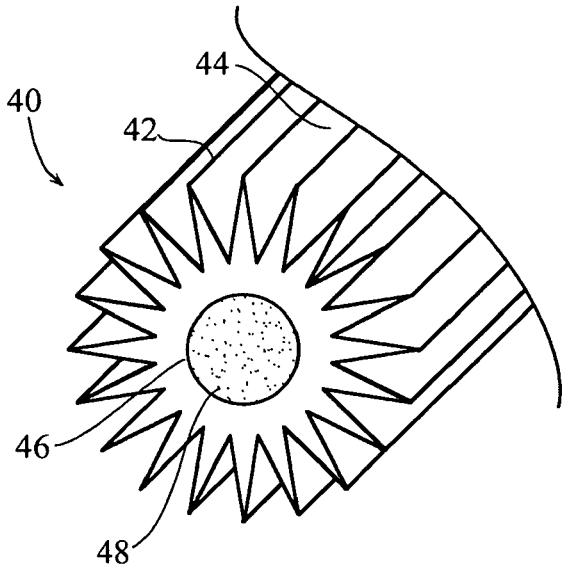
FIG. 4C is a perspective illustration of a heating unit according to certain embodiments.

The solid fuel in the heating unit can be any appropriate shape and have any appropriate dimensions. For example, as shown in FIG. 4A, solid fuel 20 can be shaped for insertion into a square or rectangular heating unit. As shown in FIG. 4B, solid fuel 20 can comprise a surface expanse 26 and side expanses 28, 30. FIG. 4C illustrates an embodiment of a heating unit. As shown in FIG. 4C, heating unit 40 comprises a substrate 42 having an exterior surface 44 and an interior surface 46. In certain embodiments, solid fuel 48, in the shape of a rod extending the length of substrate 42 fills the inner volume defined by interior surface 46. In certain embodiments, the inner volume defined by interior surface 46 can comprise an intervening space or a layer such that solid fuel 48 can be disposed as a cylinder adjacent interior surface 46, and/or be disposed as a rod exhibiting a diameter less than that of interior surface 46. It can be appreciated that a finned or ribbed exterior surface can provide a high surface area that can be useful to facilitate heat transfer from the solid fuel to an article or composition in contact with the surface.

In certain embodiments, the solid fuel is disposed on a substrate as a film or thin layer, wherein the thickness of the thin layer of solid fuel can range, for example, from 0.001 inches to 0.030 inches. The initiator composition can be placed directly on the fuel itself and ignited by a variety of means, including, for example, optical or percussive. As shown in FIG. 4A, heating unit 10 can include an initiator composition 50 which can ignite a portion of solid fuel 20. In certain embodiments, as shown in FIGS. 4A & 4B, initiator composition 50 can be positioned proximate to the center region 54 of solid fuel 20. Initiator composition 50 can be positioned at other regions of solid fuel 20, such as toward the edges. In certain embodiments, a heating unit can comprise more than one initiator composition where the more than one initiator composition 50 can be positioned on the same or different side of solid fuel 20. In certain embodiments, initiator composition 50 can be mounted in a retaining member 56 that is integrally formed with substrate 12 and/or secured within a suitably sized opening in substrate 12. Retaining member 56 and substrate 12 can be sealed to prevent release outside heating unit 10 of reactants and reaction products produced during ignition and burning of solid fuel 20. In certain embodiments, electrical leads 58*a*, 58*b* in electrical contact with initiator composition 50 can extend from retaining member 56 for electrical connection to a mechanism configured to activate (not shown) initiator composition 50.

Alternatively, the initiator composition can be placed directly on the fuel itself and ignited by a variety of means, including, for example, optical or percussive.

Figure 5A:
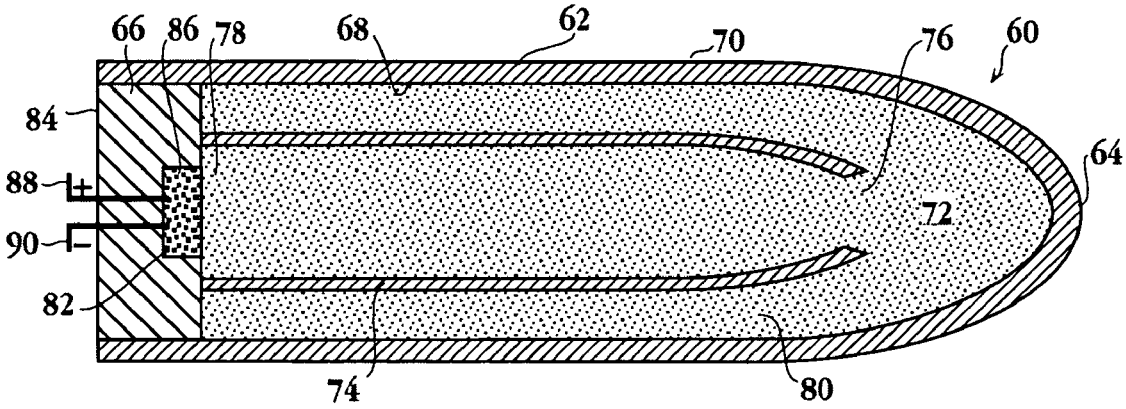
FIG. 5A is a cross-sectional illustration of a heating unit having a cylindrical geometry according to certain embodiments.

FIG. 5A shows a longitudinal cross-sectional illustration of another embodiment of a heating unit incorporating the initiator compositions of the invention. As shown in FIG. 5A, heating unit 60 includes a substrate 62 that is generally cylindrical in shape and terminates at one end in a tapered nose portion 64 and at the other end in an open receptacle 66. Substrate 62 has interior and exterior surfaces 68, 70, respectively, which define an inner region 72. An inner backing member 74 can be cylindrical in shape and can be located within inner region 72. The opposing ends 76, 78 of backing member 74 can be open. In certain embodiments, backing member 74 can comprise a heat-conducting or heat-absorbing material, depending on the desired thermal and temporal dynamics of the heating unit. When constructed of a heat-absorbing material, backing member 74 can reduce the maximum temperature reached by substrate 62 after ignition of the solid fuel 80.

In certain embodiments, solid fuel 80 comprising, for example, any of the solid fuels described herein, can be confined between substrate 62 and backing member 74 or can fill inner region 72. Solid fuel 80 can adjoin interior surface 68 of substrate 62.

In certain embodiments, an initiator composition 82, such as those described herein, can be positioned in open receptacle 66 of substrate 62, and can be configured to ignite solid fuel 80. In certain embodiments, a retaining member 84 can be located in open receptacle 66 and can be secured in place using any suitable mechanism, such as for example, bonding or welding. Retaining member 84 and substrate 62 can be sealed to prevent release of the reactants or reaction products produced during ignition and burn of initiator composition 82 and solid fuel 80. Retaining member 84 can include a recess 86 in the surface facing inner region 72. Recess 86 can retain initiator composition 82. In certain embodiments, an electrical stimulus can be applied directly to initiator composition 82 via leads 88, 90 connected to the positive and negative termini of a power source, such as a battery (not shown). Leads 88, 90 can be connected to an electrically resistive heating element placed in physical contact with the initiator composition 82 (not shown). In certain embodiments, leads 88, 90 can be coated with the initiator composition 82.

Referring to FIG. 5A, application of a stimulus to initiator composition 82 can result in the generation of sparks that can be directed from open end 78 of backing member 74 toward end 76. Sparks directed toward end 76 can contact solid fuel 80, causing solid fuel 80 to ignite. Ignition of solid fuel 80 can produce a self-propagating wave of ignited solid fuel 80, the wave traveling from open end 78 toward nose portion 64 and back toward retaining member 84 held within receptacle end 66 of substrate 62. The self-propagating wave of ignited solid fuel 80 can generate heat that can be conducted from interior surface 68 to exterior surface 70 of substrate 62.

Figure 5B:
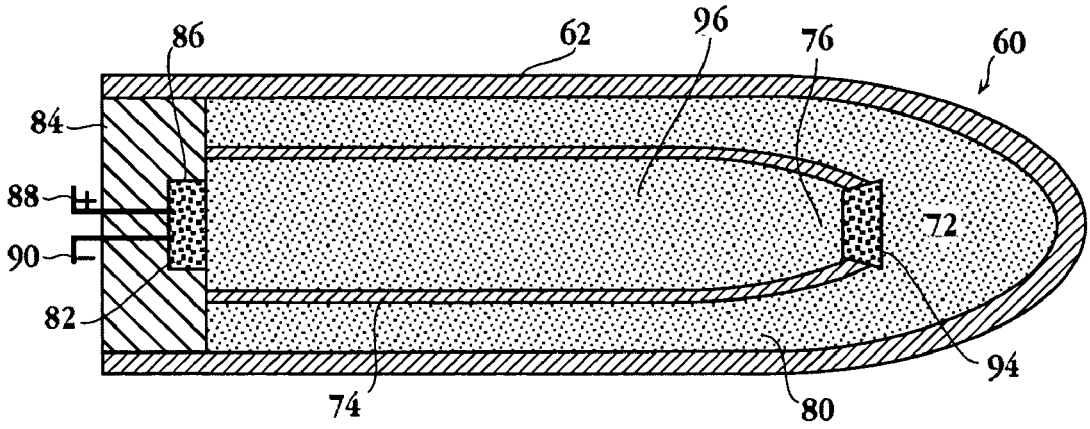
FIG. 5B is a cross-sectional illustration of a cylindrical heating unit similar to the heating unit of FIG. 5A but having a modified igniter design according to certain embodiments.

An embodiment of a heating unit with a different initiation step up, using initiator compositions of the invention, is illustrated in FIG. 5B. As shown in FIG. 5B, heating unit 60 can comprise a first initiator composition 82 disposed in recess 86 in retaining member 84 and a second initiator composition 94 disposed in open end 76 of backing member 74. Backing member 74, located within inner region 72, defines an open region 96. Solid fuel 80 is disposed within the inner region between substrate 62 and backing member 74. In certain embodiments, sparks generated upon application of an electrical stimulus to first initiator composition 82, through leads 88, 90, can be directed through open region 96 toward second initiator composition 94, causing second initiator composition 94 to ignite and generate sparks. Sparks generated by second initiator composition 94 can then ignite solid fuel 80, with ignition initially occurring toward the nose portion of substrate 62 and traveling in a self-propagating wave of ignition to the opposing end.

In certain embodiments, the heating units described and illustrated in FIGS. 4A–4C and 5A–5B with initiator composition of the invention can be used in applications wherein rapid heating is useful. As an example, the heating unit substantially as illustrated in FIG. 5B was fabricated to access ignition of the solid fuel using an initiator composition of the invention. Referring to FIG. 5B, cylindrical substrate 62 was approximately 1.5 inches in length and the diameter of open receptacle 66 was 0.6 inches. Solid fuel 80 comprising 75% Zr:25% $MoO_3$ in weight percent was placed in the inner region in the space between the backing member 74 and the interior surface of substrate 62. A first initiator composition 82 comprising 5 mg of 10% Zr:22.5% B:67.5% $KClO_3$ in weight percent was placed in the depression of the retaining member and 10 mg of a second initiator composition 94 of 10% Zr:22.5% B:67.5% $KClO_3$ in weight percent was placed in the open end 76 of backing member 74 near the tapered portion of heating unit 60. Electrical leads 88, 90 from two 1.5 V batteries provided a current of 0.3 Amps to ignite first initiator composition 82, thus producing sparks to ignite second initiator composition 94. Both initiators were ignited within 1 to 20 milliseconds following application of the electrical current. Sparks produced by second initiator composition 94 ignited solid fuel 80 in the tapered nose region 64 of the cylinder resulting in the exterior substrate surface reaching a maximum temperature of 400° C. in less than 100 milliseconds.

When sealed within an enclosure, the exothermic oxidation-reduction reaction of the fuel and/or initiator composition can generate a significant increase in pressure. In certain embodiments, the internal pressure of a heating unit can be managed or reduced by constructing the substrate, backing, and any other internal components from materials that produce minimal gas products at elevated temperatures. In certain embodiments, pressure can be managed or reduced by providing an interior volume wherein gas can be collected and/or vented when the initiator and solid fuel are burned. In certain embodiments, the interior volume can include a porous or fibrous material having a high surface area and a large interstitial volume. In certain embodiments, the immediate burst of pressure resulting from the solid fuel burn can be reduced by locating an impulse absorbing material and/or coating within the heating unit. Impulse absorbing materials are described in the literature and U.S. application entitled "Self Contained Heating Unit and Drug Supply Unit Employing the Same," filed May 20, 2004 An embodiment of a heating unit comprising an impulse absorbing material is schematically illustrated in FIGS. 6A–6B and FIGS. 7A–7B.

Figure 6B:
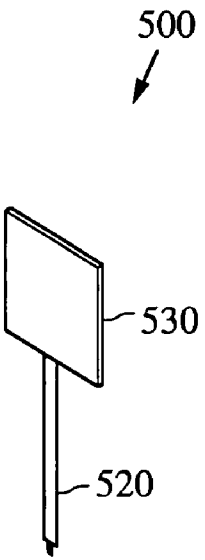
FIGS. 6A–6B show illustrations of a perspective view (FIG. 6A) and an assembly view (FIG. 6B) of a heating unit according to certain embodiments that are actuated by electrical resistance.
Figure 6A:
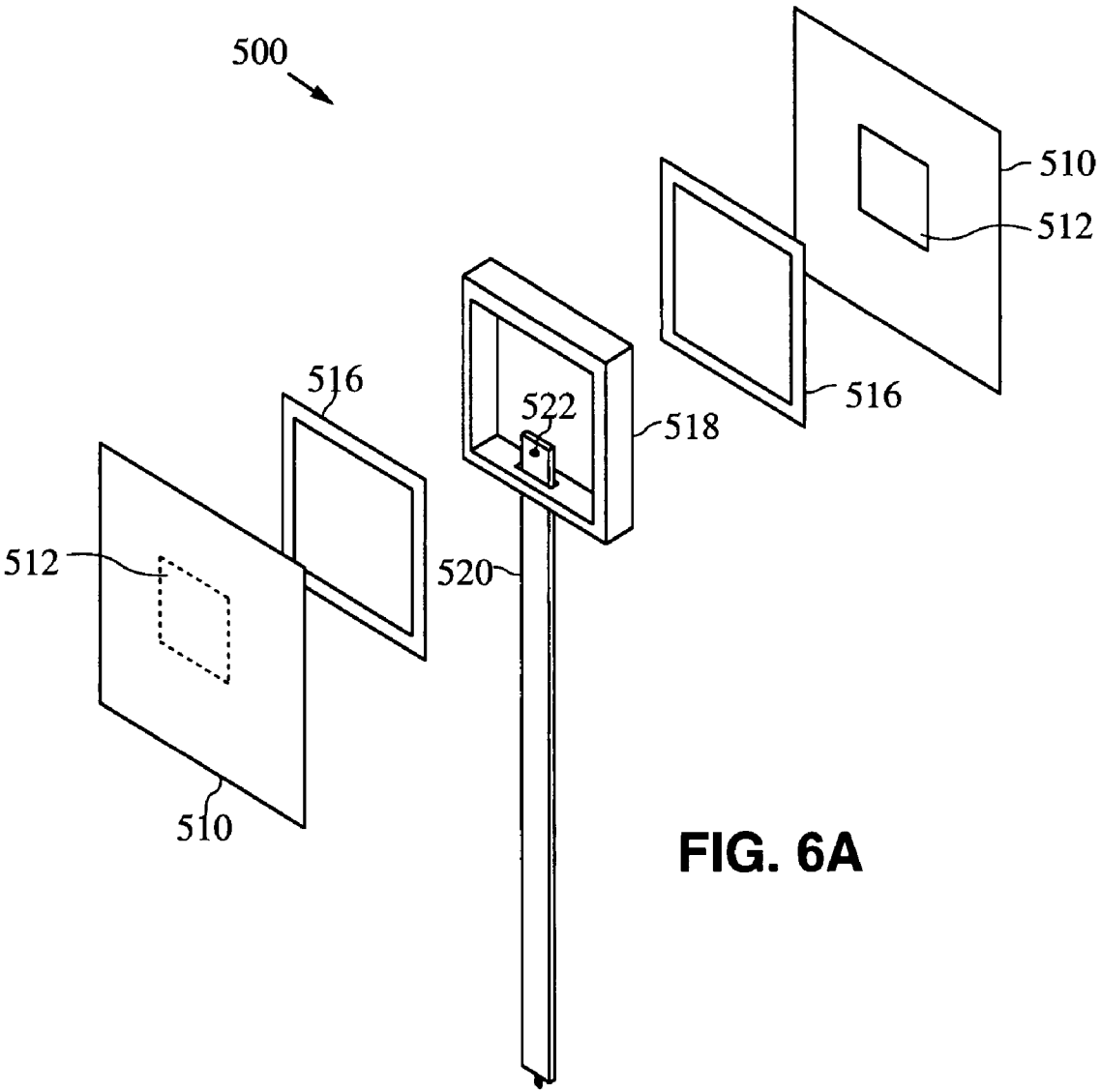

An embodiment of a heating unit using an igniter of the invention, such as, for example, shown in FIG. 1 and initiator compositions of the invention, is illustrated in FIGS. 6A–6B. FIG. 6A illustrates a perspective view, and FIG. 6B an assembly view of the heating unit 500. As shown in FIG. 6A, heating unit 530 comprises a first and a second substrate 510, and a spacer 518.

The first and second substrates 510 include an area comprising solid fuel 512 disposed on the interior surface. First and second substrates 510 can comprise a thermally conductive material such as those described herein, including, for example, metals, ceramics, and thermally conductive polymers. In certain embodiments, substrates 510 can comprise a metal, such as, but not limited to, stainless steel, copper, aluminum, and nickel, or an alloy thereof. The thickness of substrates 510 can be thin to facilitate heat transfer from the interior to the exterior surface and/or to minimize the thermal mass of the device. In certain embodiments, a thin substrate can facilitate rapid and homogeneous heating of the exterior surface with a lesser amount of solid fuel compared to a thicker substrate. Substrate 510 can also provide structural support for solid fuel 512. In certain embodiments, substrates 510 can comprise a metal foil. In certain embodiments, the thickness of substrates 510 can range from 0.001 inches to 0.020 inches, in certain embodiments from 0.001 inches to 0.010 inches, in certain embodiments from 0.002 inches to 0.006 inches, and in certain embodiments from 0.002 inches to 0.005 inches. The use of lesser amounts of solid fuel can facilitate control of the heating process as well as facilitate miniaturization of a drug supply unit.

In certain embodiments, the thickness of substrates 510 can vary across the surface. For example, a variable thickness can be useful for controlling the temporal and spatial characteristics of heat transfer and/or to facilitate sealing of the edges of substrates 510, for example, to spacer 518, opposing substrate 510, or to another support (not shown). In certain embodiments, substrates 510 can exhibit a uniform or nearly uniform thickness in the region of the substrate on which solid fuel 512 is disposed to facilitate achieving a uniform temperature across that region of the substrate on which the solid fuel is disposed.

Substrates 510 comprises an area of solid fuel 512 disposed on the interior surface, e.g. the surface facing opposing substrate 510. Solid fuel 512 can be applied to substrate 510 using any appropriate method. For example, solid fuel 512 can be applied to substrate 510 by brushing, dip coating, screen printing, roller coating, spray coating, inkjet printing, stamping, spin coating, and the like. Solid fuel 512 can be applied to a portion of substrates 510 as a thin film or layer. The thickness of the thin layer of solid fuel 512, and the composition of solid fuel 512 can determine the maximum temperature as well as the temporal and spatial dynamics of the temperature profile produced by the burning of the solid fuel.

In certain embodiments, solid fuel 512 can comprise a mixture of $Zr/MoO_3$, $Zr/Fe_2O_3$, $Al/MoO_3$, or $Al/Fe_2O3$. In certain embodiments, the amount of metal reducing agent can range from 60 wt % to 90 wt %, and the amount of metal-containing oxidizing agent can range from 40 wt % to 10 wt %.

As shown in FIGS. 6A–6B, the heating unit comprises an ignition assembly or igniter 520. In certain embodiments, igniter 520 can comprise an initiator composition 522 capable of producing sparks when heated, disposed on an electrically resistive heating element connected to electrical leads disposed between two strips of insulating materials (not shown). The heating element on which an initiator composition is disposed can be exposed through an opening in the end of ignition assembly 520. The electrical leads can be connected to a power source (not shown).

Initiator composition 522 can comprise any of the initiator compositions or compositions described herein.

Igniter 520 can be positioned with respect to solid fuel 512 such that sparks produced by initiator composition 522 can be directed toward solid fuel area 512, causing solid fuel 512 to ignite and burn. Initiator composition 522 can be located in any position such that sparks produced by the initiator can cause solid fuel 512 to ignite. The location of initiator composition 522 with respect to solid fuel 512 can determine the direction in which solid fuel 512 burns. The igniter 520 is preferentially positioned such that the plumes generated from the igniter are directed to the surface of the solid fuel, so that both fuel coated substrates ignite.

In certain embodiments, heating unit 500 can comprise more than one igniter 520 and/or each igniter 520 can comprise more than one initiator composition 522.

As shown in FIG. 6A, heating unit 500 can have a spacer 518. Spacer 518 can retain igniter 520. In certain embodiments, spacer 518 can provide a volume or space within the interior of thin film heating unit 500 to collect gases and byproducts generated during the burn of the solid fuel 512. The volume produced by spacer 518 can reduce the internal pressure within the heating unit 500 upon ignition of the fuel. In certain embodiments, the volume can comprise a porous or fibrous material such as a ceramic, or fiber mat in which the solid matrix component is a small fraction of the unfilled volume. The porous or fibrous material can provide a high surface area on which reaction products generated during the burning of the initiator composition and the solid fuel can be absorbed, adsorbed or reacted. The pressure produced during burn can in part depend on the composition and amount of initiator composition and solid fuel used. In certain embodiments, the spacer can be less than 0.3 inches thick, and in certain embodiments less than 0.2 inches thick. In certain embodiments, the maximum internal pressure during and following burn can be less than 50 psig, in certain embodiments less than 20 psig, in certain embodiments less than 10 psig, and in other certain embodiments less than 6 psig. In certain embodiments, the spacer can be a material capable of maintaining structural and chemical properties at the temperatures produced by the solid fuel burn. In certain embodiments, the spacer can be a material capable of maintaining structure and chemical properties up to a temperature of about 100° C. It can be useful that the material forming the spacer not produce and/or release or produce only a minimal amount of gases and/or reaction products at the temperatures to which it is exposed by the heating unit. In certain embodiments, spacer 518 can comprise a metal, a thermoplastic, such as, for example, but not limitation, a polyimide, fluoropolymer, polyetherimide, polyether ketone, polyether sulfone, polycarbonate, other high temperature resistant thermoplastic polymers, or a thermoset, and which can optionally include a filler.

In certain embodiments, spacer 518 can comprise a thermal insulator such that the spacer does not contribute to the thermal mass of the thin film drug supply unit thereby facilitating heat transfer to the substrate on which drug 514 is disposed. Thermal insulators or impulse absorbing materials such as mats of glass, silica, ceramic, carbon, or high temperature resistant polymer fibers can be used. In certain embodiments, spacer 518 can be a thermal conductor such that the spacer functions as a thermal shunt to control the temperature of the substrate.

Substrates 510, spacer 518 and igniter 520 can be sealed. Sealing can retain any reactants and reaction products released by burning of solid fuel 514, as well as provide a self-contained unit. As shown in FIG. 6A, substrates 510 can be sealed to spacer 518 using an adhesive 516. Adhesive 516 can be a heat sensitive film capable of bonding substrates 510 and spacer 518 upon the application of heat and pressure. In certain embodiments, substrates 510 and spacer 518 can be bonded using an adhesive applied to at least one of the surfaces to be bonded, the parts assembled, and the adhesive cured. The access in spacer 518 into which igniter 520 is inserted can also be sealed using an adhesive. In certain embodiments, other methods for forming a seal can be used such as for example, welding, soldering, or fastening.

In certain embodiments, the elements forming heating unit 500 can be assembled and sealed using thermoplastic or thermoset molding methods such as insert molding and transfer molding.

An appropriate sealing method can, at least in part be determined by the materials forming substrate 510 and spacer 518. In certain embodiments, heating unit 500 can be sealed to withstand a maximum pressure of less than 50 psig. In certain embodiments less than 20 psig, and in certain embodiments less than 10 psig.

Example 8 describes the preparation of a heating unit comprising an thermal resistive igniter of the invention coated with an initiator composition of the invention.

In other embodiments of heating units comprising initiator compositions of the invention, an optical ignition system can also be used to ignite the heating unit. Optical ignition requires the use either a light sensitive material or initiator composition and a light source for actuation of the light sensitive material or initiator composition or a very high intensity light source, e.g., a laser.

Various initiator compositions such as those discussed above, can be used. In certain embodiments, metals such as, for example, aluminum, zirconium, and titanium and oxidizing agents such as potassium chlorate, potassium perchlorate, copper oxide, tungsten trioxide, and molybdenum trioxide can be used. Typically, one or more of the initiator composition materials are light absorptive or are coated with light absorptive chemicals. Metal and oxidizing agent containing initiator compositions that are sensitive to a specific wavelength or range of wavelengths, such as, for example, compositions that are highly absorptive in the ultraviolet region of the electromagnetic spectrum can also be used. By changing the ratio of the solid materials in the initiator composition, it is possible to make the final initiator composition release more or less energy, as is needed, and to be more or less sensitive to light pulses.

The initiator composition can be applied directly to the fuel on the substrate, on an igniter, such as those disclosed herein, or positioned elsewhere within the heating unit as long as there is a clear optical window for directing the light to the initiator composition or material and that upon actuation the initiator composition ignites the fuel within the heating unit. In certain embodiments, the initiator compositions can be placed within a hole in a glass fiber filter that is placed adjacent to the surface of the coated fuel.

Ignition of the fuel in a heat package is actuated by transmission of a light pulse through a clear optical window to the initiator compositions. The optical window can be made of any material that readily transmits a light pulse, such as for example, glass, acrylic, or polycarbonate. The window can be positioned in any location to transmit the light to the initiator. In certain embodiments, the window forms part of the enclosure of the heating unit. In other embodiments, the window is completely contained in the system. In certain embodiments the window is part of a light guide assembly. The light guide assembly can also consist of a beam splitter. The light coming from the light source passes through the beam splitter and can be directed to two or more initiator compositions located within the heating unit for initiation of two or more fuel coated substrates at the same time or in sequence. Optionally, an optical fiber can be used to fire multiple heating units at the same time. In other embodiments, the window can be coated by a material which causes the wavelength of the light which it emits to be different from the light which it receives. For example, the radiant optical source could emit ultraviolet light, and the coating could be used to give off a visible wavelength in response to the ultraviolet light.

Various means for actuating the optical ignition can be used. In certain embodiments, an electrically conductive means for generating a light pulse upon achieving a threshold voltage is provided. The electrically conductive means can be part of the heating unit itself, e.g., included in a spacer of the heating unit or separate from the heating unit. The electrically conductive means for generating a light pulse can include, for example a Xenon flash lamp, a light emitting diode, and a laser.

Figure 7A:
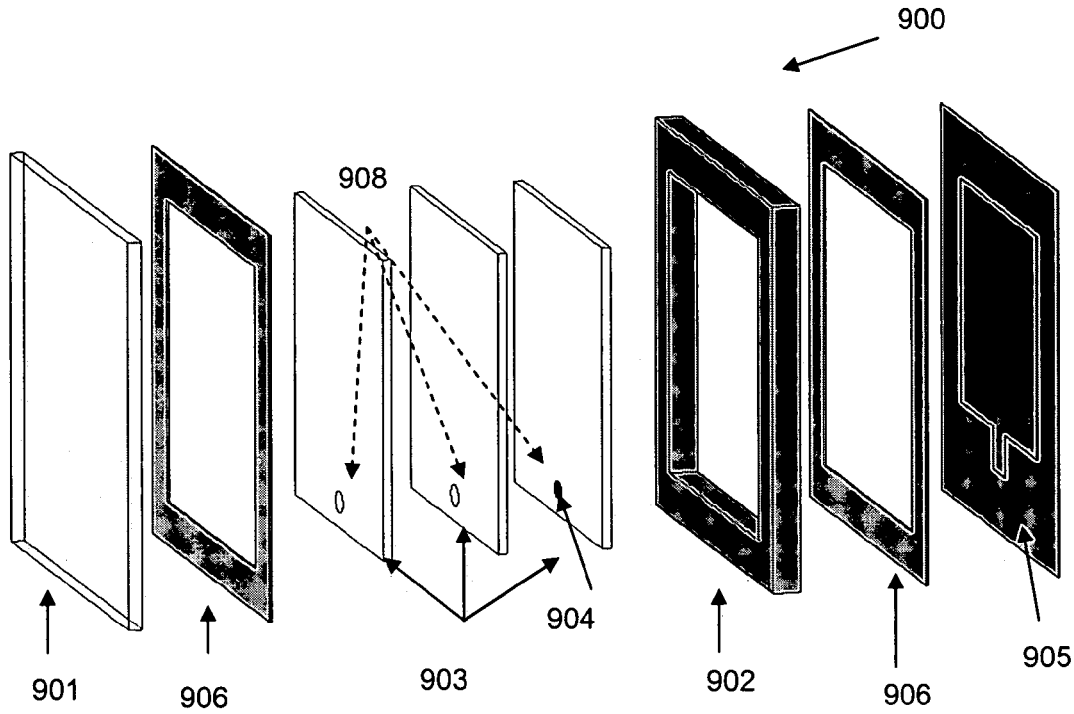
FIGS. 7A & 7B show illustrations of perspective view of a heating unit according to certain embodiments that are actuated by optical ignition.
Figure 7B:
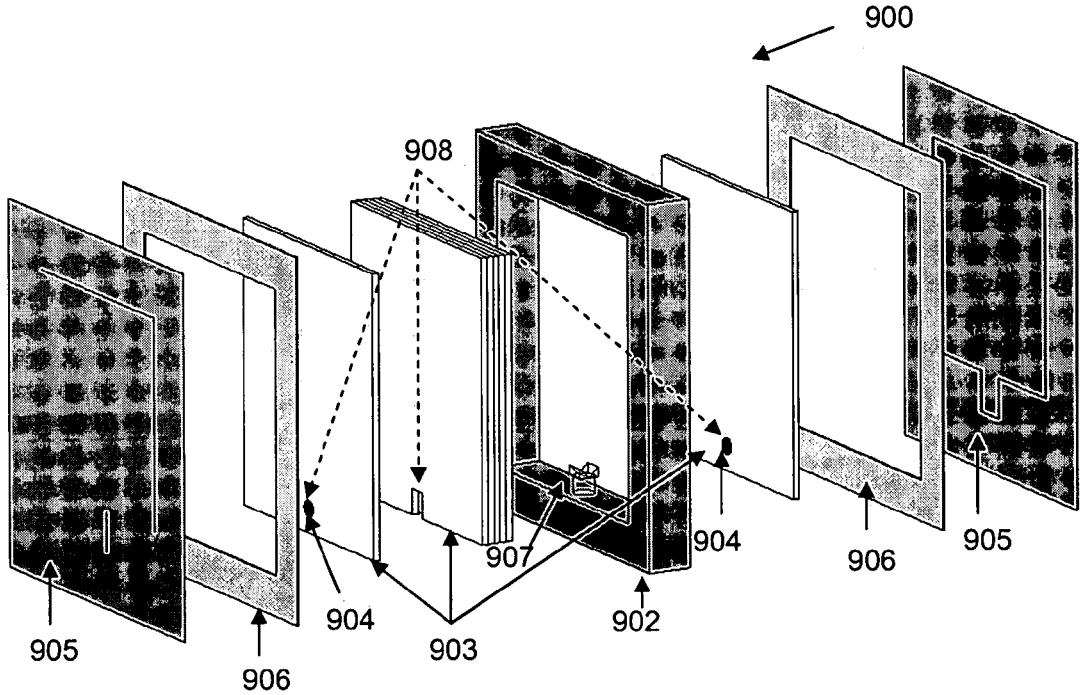

Several embodiments of a heating unit 900 comprising an optical ignition system are illustrated in FIGS. 7A–B. As shown, initiator composition 904 is contained within a hole 908 in an impulse absorbing material 903, such that the initiator composition 904 is adjacent to the fuel coating. One or more impulse absorbing materials 903 can be added to the heating unit, as long as there is not an obstruction by the impulse absorbing material that would prevent contact between the ignited initiator composition and the solid fuel. Holes or spaces 908 can be cut into the impulse absorbing materials 903 to provide an opening for such contact. More than one initiator composition 904 can be placed in a single heating unit 900, as shown in FIG. 7B, for initiating the burning of more than one solid fuel coating at a time. The impulse absorbing material can be fit into a spacer 902 as shown in FIGS. 7A–7B.

As shown in FIG. 7A, an optical window 901 can form part of the enclosure of the heating unit. In some embodiments, the optical window 901 forms part of a wave guide system (not shown) which includes a beam splitter 907, as shown in FIG. 7B. The beam splitter 907 can be used to direct one source of light to two initiator composition, so as to ignite both solid fuel coated substrates together.

Various means can be used to seal the heating unit. Sealant 906 can be an adhesive, such as double sided tape or epoxy, or any other methods for forming a seal, such as for example, welding, soldering, fastening or crimping.

In certain embodiments, the light source (not shown) can be part of the heating unit, and can be contained within the spacer 902 contained in the heating unit 900. The light source can be powered by a battery (not shown).

An example of the preparation of a single heating unit using optical ignition is described in Example 9.

Percussion ignition can also be used to ignite compositions of the invention in a heating unit. Percussion ignition generally comprises a deformable ignition tube within which is an anvil coated with an initiator composition. Ignition is activated by mechanical impact or force.

For the initiator composition to operate satisfactorily when actuated, the material must exhibit the proper ignition sensitivity as well as ignite the solid fuel properly. Various initiator compositions can be used such as those disclosed herein. Typically, the initiator compositions are prepared as liquid suspension in an organic or aqueous solvent for coating the anvil and soluble binders are generally included to provide adhesion of the coating to the anvil.

By changing the ratio of the solid materials in the initiator composition, it is possible to make the final initiator composition release more or less energy, as is needed, and to be more or less sensitive to air or oxygen and shock.

The coating of the initiator material can be applied to the anvil in various known ways. For example, the anvil can be dipped into a slurry of the initiator composition followed by drying in air or heat to remove the liquid and produce a solid adhered coating having the desired characteristic previously described. Alternately, the slurry can be sprayed or spin coated on the anvil and thereafter processed to provide a solid coating. The thickness of the coating of the initiator composition on the anvil should be such, that when the anvil is placed in the ignition tube, the initiator composition is a slight distance of around a few thousandths of an inch or so, for example, 0.004 inch, for the inside wall of the ignition tube.

The anvil on which the initiator composition is disposed is typically a metal wire or rod. It should be of a suitable metallic composition such that it exhibits a high temperature resistance and low thermal conductivity, such as, for example, stainless steel. The anvil is disposed within the metal ignition tube and extended substantially coaxially. Thus, the anvil should be of a slightly smaller diameter than the inside diameter of the ignition tube so as to be spaced a slight distance, for example, about 0.05 inches or so from the inside wall thereof.

The anvil is disposed within a metal ignition tube. The ignition tube should be of readily deformable materials and can comprise a thin-walled (for example, 0.003-inch wall thickness) tube of a suitable metallic composition, such as for example, aluminum, nickel-chromium iron alloy, brass, or steel. The anvil can be held or fastened in place in the ignition tube near its outer end by crimping or any other method typically used.

Ignition of the fuel is actuated by a forceful mechanical impact or blow applied against the side of the metal ignition tube to deform it inwardly against the coating of the initiator material on the anvil, which causes deflagration of the initiator material up through the ignition tube into the fuel coated heating unit. Various means for providing mechanic impact can be used. In certain embodiments a spring loaded impinger or striker is used to actuate the ignition.

Figure 8:
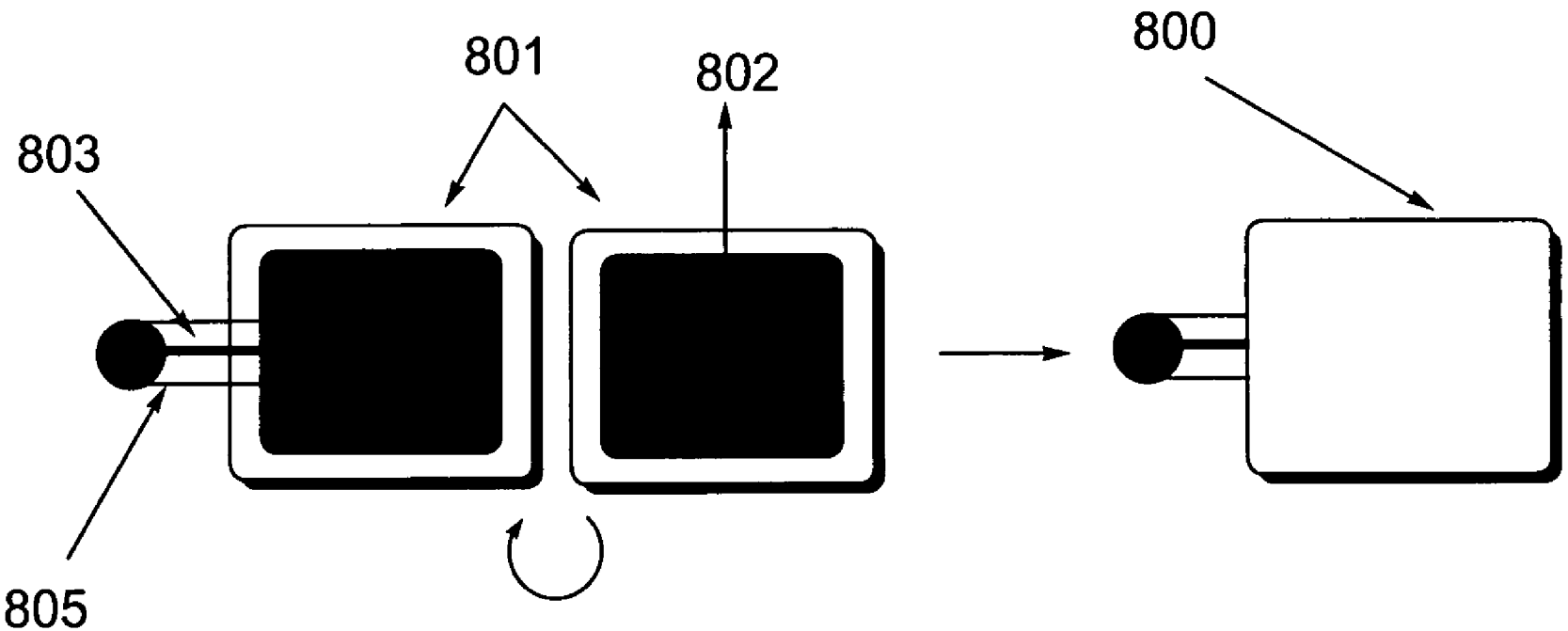
FIG. 8 is a schematic illustration of a heating unit according to certain embodiments that are actuated by percussion ignition.

An embodiment of a heating unit 800 comprising a percussive igniter is illustrated in FIG. 8 As shown in FIG. 8, a deformable ignition tube 805, with an initiator composition coated anvil 803 contained therein, is placed between two substrates 801 coated with solid fuel 802, with the open end of the ignition tube disposed within the heating unit 800. The heating unit 800 is then sealed.

An example of the preparation of a heating unit using percussion ignition is described in Example 10

Other embodiments will be apparent to those skilled in the art from consideration and practice of the invention disclosed herein. It is intended that the specification and examples be considered as exemplary only.

EXAMPLES

In the examples below, the following abbreviations have the following meanings. If an abbreviation is not defined, it has its generally accepted meaning.

wt % weight percent
psig pounds per square inch, gauge
DI deionized
mL milliliters
msec milliseconds
L/min liters per minute
μm micrometer

Example 1

Initiator Composition Embodiment

The following procedure was used to prepare a slurry of an initiator compositios comprising 23.7% Zr:23.7% $MoO_3$: 2.4% Laponite® RDS:50.2% water.

To prepare wet Zirconium (Zr), the as-obtained suspension of Zr in DI water (Chemetall, Germany) was agitated on a roto-mixer for 30 minutes. Ten to 40 mL of the wet Zr was dispensed into a 50 mL centrifuge tube and centrifuged (Sorvall 6200RT) for 30 minutes at 3,200 rpm. The DI water was removed to leave a wet Zr pellet.

To prepare a 15% Laponite® RDS solution, 85 grams of DI water was added to a beaker. While stirring, 15 grams of Laponite® RDS (Southern Clay Products, Gonzalez, Tex.) was added, and the suspension stirred for 30 minutes.

The reactant slurry was prepared by first removing the wet Zr pellet as previously prepared from the centrifuge tube and placing it in a beaker. Upon weighing the wet Zr pellet, the weight of dry Zr was determined from the following equation: Dry Zr(g)=0.8234 (Wet Zr(g))−0.1059. The dry weight of Zr was determined to be 2.701 g.

To the wet Zr was added 2.701 g of $MoO_3$ to form a 50:50 slurry of Zr: to $MoO_3$ by weight. Excess water to obtain a reactant slurry comprising 50.2% DI water was added to the wet Zr and $MoO_3$ slurry. The reactant slurry was mixed for 5 minutes using an IKA Ultra-Turrax mixing motor with a S25N-8G dispersing head (setting 4). To the slurry was added 15% Laponite® RDS (1.816 g to provide a final mixture of fuel, water, and Laponite that comprised 2.4% Laponite). The slurry was mixed for an additional 5 minutes using the IKA Ultra-Turrax mixer.

Example 2

Initiator Composition Embodiment

An initiator composition was prepared by adding 8.6 mL of a homogenous 4.25% Viton A500 (Dupont)/amyl acetate solution to a mixture of 0.680 g of Al (40–70 nm, Argonide), 1.320 g of $MoO_3$ (nanosized, Climax Molybdenum), and 0.200 g of boron (nanosized, Aldrich) and mixing well with an homogenizer blade. The mixture was homogenized at speed 1 for 30 seconds, then at speed 2 for 4 min.

Example 3

Preparation of Igniter

The ignition assembly comprised a cleaned 0.005 inch thick FR-4 printed circuit board (1.820 inches×0.25 inches) having a 0.03 inch diameter opening at one end and two copper tracings each 0.35 inches×1.764 inches, one on each side of the hole, printed along the length of the circuit board and a 0.0008 inch diameter Nichrome wire positioned across the opening and soldered to the gold plated copper tracings on the printed circuit board.

An initiator composition was prepared by adding 8.6 mL of a homogenous 4.25% Viton A500/amyl acetate solution to a mixture of 0.680 g of Al (40–70 nm, Argonide), 1.320 g of $MoO_3$ (nanosized, Climax Molybdenum), and 0.200 g of boron (nanosized, Aldrich) and mixing well with an homogenizer blade. A 1.1 μL drop of the initiator composition was placed on the Nichrome wire over the hole using a Cavro Syringe Pump. The initiator composition was allowed to air dry for 10 min. The igniter was turned over and an additional 0.8 μL drop of initiator composition was put on the other side of the wire. The composition was allowed to air dry for at least 10 min.

Example 4

Thermal Stability of Igniter

Twenty-nine igniters, prepared as in Example 3, were heated at 100° C. for 4 hours and thirty-two igniters, prepared as in Example 3, were heated at 100° C. for 6 hours. The igniters heated for 4 hours were heated for 30 min. at 100° C., then exposed to desiccated and ambient air at room temperature, heated again for 30 min. at 100° C., again exposed to desiccated and ambient air at room temperature and finally heated 3 hours at 100° C. The igniters were fired and the intensity of the light (V-sec) for each igniter was measured, as described in Example 7 below, and compared to sixty-three controls that were not heated. No measurable difference between the heat-treated and the non-treated igniters was observed.

Example 5

Freeze Stability of Igniter

Eighteen igniters, prepared as in Example 3, were placed in scintillation vials and then tightly capped to prevent condensation. Vials were wrapped in aluminum foil and placed in a freezer at −20° C. for 48 hours. The igniters were fired and the intensity of the light (V-sec) for each igniter was measured, as described in Example 7 below, and compared to sixty-three controls that were not frozen. No measurable difference between the frozen and the non-frozen igniters was observed.

Example 6

Mechanical Stability of Igniter

Six igniters prepared as in Example 3, were vortexed for 24 and eight igniters, prepared as in Example 3, were vortexed for 48 hours at high speed (speed 7, VWR 22830). The igniters were analyzed under a microscope before vortexing and after and changes in morphology, cracking, and/or flaking were assessed. No differences between the vortexed and the non-treated igniters were observed.

Example 7

Measurement of Light Intensity from Igniter

Initiator compositions were actuated and the light intensity was measured by monitoring the time history of energy released from actuation of the initiator composition.

Igniters were prepared essentially as discussed in Example 3 using various compositions of the invention.

To measure light intensity from actuation of the igniter, a photo detector (Newport, 818-IR) was used as shown in FIG. 2 and the time history of light intensity was recorded by an oscilloscope (Tektronix, TDS3014B). The voltage out put signal from the photo detector is proportional to the light intensity at a given wavelength.

The igniters were fired using 2×A76 batteries (3.13V total). Representative graphs of intensity vs time (ms) are illustrated in FIGS. 3A & 3B, with initiator compositions of the invention. FIG. 3A is a graph from an initiator composition comprising a mixture of 0.4 μL nanoZr:nano$MoO_3$ (50:50) and 1 μL nanoZr:micro $MoO_3$ (50:50), with nitrocellulose binder, and FIG. 3B is a graph from an initiator composition as prepared in Example 2.

Example 8

Heating Unit Embodiment with Resistive Igniters

A heating unit according to FIGS. 6A–6B was fabricated and the performance evaluated.

The following procedure was used to prepare solid fuel coatings comprising 76.16% Zr:19.04% $MoO_3$:4.8% Laponite® RDS.

To prepare wet Zirconium (Zr), the as-obtained suspension of Zr in DI water (Chemetall, Germany) was agitated on a roto-mixer for 30 minutes. Ten to 40 mL of the wet Zr was dispensed into a 50 mL centrifuge tube and centrifuged (Sorvall 6200RT) for 30 minutes at 3,200 rpm. The DI water was removed to leave a wet Zr pellet.

To prepare a 15% Laponite® RDS solution, 85 grams of DI water was added to a beaker. While stirring, 15 grams of Laponite® RDS (Southern Clay Products, Gonzalez, Tex.) was added, and the suspension stirred for 30 minutes.

The reactant slurry was prepared by first removing the wet Zr pellet as previously prepared from the centrifuge tube and placing in a beaker. Upon weighing the wet Zr pellet, the weight of dry Zr was determined from the following equation: Dry Zr (g)=0.8234 (Wet Zr(g))−0.1059.

The amount of molybdenum trioxide to provide a 80:20 ratio of Zr to $MoO_3$ was then determined, e.g, $MoO_3$=dry Zr(g)/4, and the appropriate amount of $MoO_3$ powder (Accumet, N.Y.) was added to the beaker containing the wet Zr to produce a wet Zr:$MoO_3$ slurry. The amount of Laponite® RDS to obtain a final weight percent ratio of dry components of 76.16% Zr:19.04% $MoO_3$:4.80% Laponite® RDS was determined. Excess water to obtain a reactant slurry comprising 40% DI water was added to the wet Zr and $MoO_3$ slurry. The reactant slurry was mixed for 5 minutes using an IKA Ultra-Turrax mixing motor with a S25N-8G dispersing head (setting 4). The amount of 15% Laponite® RDS previously determined was then added to the reactant slurry, and mixed for an additional 5 minutes using the IKA Ultra-Turrax mixer. The reactant slurry was transferred to a syringe and stored for at least 30 minutes prior to coating.

The Zr:$MoO_3$:Laponite® RDS reactant slurry was then coated onto stainless steel foils. Stainless steel foils were first cleaned by sonication for 5 minutes in a 3.2% by solution of Ridoline 298 in DI water at 60° C. Stainless steel foils were masked with 0.215 inch wide Mylar® such that the center portion of each 0.004 inch thick 304 stainless steel foil was exposed. The foils were placed on a vacuum chuck having 0.008 inch thick shims at the edges. Two (2) mL of the reactant slurry was placed at one edge of the foil. Using a Sheen Auto-Draw Automatic Film Applicator 1137 (Sheen Instruments) the reactant slurry was coated onto the foils by drawing a #12 coating rod at an auto-draw coating speed of up to 50 mm/sec across the surface of the foils to deposit approximately an 0.006 inch thick layer of the Zr:$MoO_3$:Laponite® RDS reactant slurry. The coated foils were then placed in a 40° C. forced-air convection oven and dried for at least 2 hours. The masks were then removed from the foils to leave a coating of solid fuel on the center section of each foil.

The spacer comprised a 0.24 inch thick section of polycarbonate (Makronlon).

The ignition assembly comprised a FR-4 printed circuit board having a 0.03 inch diameter opening at the end to be disposed within an enclosure defined by the spacer and the substrates. A 0.0008 inch diameter Nichrome wire was soldered to electrical conductors on the printed circuit board and positioned across the opening. An initiator composition comprising 26.5% Al, 51.4% $MoO_3$, 7.7% B and 14.3% Viton A500 dry weight percent was deposited onto the Nichrome wire and dried.

To assemble the heating unit, the Nichrome wire comprising the initiator composition was positioned at one end of the solid fuel area. A bead of epoxy (Epo-Tek 353 ND, Epoxy Technology) was applied to both surfaces of the spacer, and the spacer, substrates and the ignition assembly positioned and compressed. The epoxy was cured at a temperature of 100° C. for 3 hours.

To ignite the solid fuel, a 0.4 Amp current was applied to the electrical conductors connected to the Nichrome wire.

Measurements on such heating units demonstrated that the exterior surface of the substrate reached temperatures in excess of 400° C. in less than 150 milliseconds following activation of the initiator. The maximum pressure within the enclosure was less than 10 psig. In separate measurements, it was demonstrated that the enclosure was able to withstand a static pressure in excess of 60 psig at room temperature. The burn propagation speed across the expanse of solid fuel was measured to be 25 cm/sec.

Example 9

Heating Unit Embodiment with Optical Ignition using Initiator Composition

A heating unit according to FIG. 7A was fabricated and the performance evaluated.

The following procedure was used to prepare solid fuel coatings comprising 76.16% Zr:19.04% $MoO_3$:4.8% Laponite® RDS.

To prepare wet Zirconium (Zr), the as-obtained suspension of Zr in DI water (Chemetall, Germany) was agitated on a roto-mixer for 30 minutes. Ten to 40 mL of the wet Zr was dispensed into a 50 mL centrifuge tube and centrifuged (Sorvall 6200RT) for 30 minutes at 3,200 rpm. The DI water was removed to leave a wet Zr pellet.

To prepare a 15% Laponite® RDS solution, 85 grams of DI water was added to a beaker. While stirring, 15 grams of Laponite® RDS (Southern Clay Products, Gonzalez, Tex.) was added, and the suspension stirred for 30 minutes.

The reactant slurry was prepared by first removing the wet Zr pellet as previously prepared from the centrifuge tube and placing it in a beaker. Upon weighing the wet Zr pellet, the weight of dry Zr was determined from the following equation: Dry Zr(g)=0.8234 (Wet Zr(g))−0.1059.

The amount of molybdenum trioxide to provide an 80:20 ratio of Zr to $MoO_3$ was then determined, e.g, $MoO_3$=dry Zr(g)/4, and the appropriate amount of $MoO_3$ powder (Accumet, N.Y.) was added to the beaker containing the wet Zr to produce a wet Zr:$MoO_3$ slurry. The amount of Laponite® RDS to obtain a final weight percent ratio of dry components of 76.16% Zr:19.04% $MoO_3$:4.80% Laponite® RDS was determined. Excess water to obtain a reactant slurry comprising 40% DI water was added to the wet Zr and $MoO_3$ slurry. The reactant slurry was mixed for 5 minutes using an IKA Ultra-Turrax mixing motor with a S25N-8G dispersing head (setting 4). The amount of 15% Laponite® RDS previously determined was then added to the reactant slurry, and mixed for an additional 5 minutes using the IKA Ultra-Turrax mixer. The reactant slurry was transferred to a syringe and stored for at least 30 minutes prior to coating.

The Zr:$MoO_3$:Laponite® RDS reactant slurry was then coated onto stainless steel foils. Stainless steel foils were first cleaned by sonication for 5 minutes in a 3.2% by solution of Ridoline 298 in DI water at 60° C. Stainless steel foils were masked with 0.215 inch wide Mylar® such that the center portion of each 0.004 inch thick 304 stainless steel foil was exposed. The foils were placed on a vacuum chuck having 0.008 inch thick shims at the edges. Two (2) mL of the reactant slurry was placed at one edge of the foil. Using a Sheen Auto-Draw Automatic Film Applicator 1137 (Sheen Instruments) the reactant slurry was coated onto the foils by drawing a #12 coating rod at an auto-draw coating speed of up to 50 mm/sec across the surface of the foils to deposit approximately an 0.006 inch thick layer of the Zr:$MoO_3$:Laponite® RDS reactant slurry. The coated foils were then placed in a 40° C. forced-air convection oven and dried for at least 2 hours. The masks were then removed from the foils to leave a coating of solid fuel on the center section of each foil.

An initiator composition was prepared by adding 8.6 mL of a 4.25% Viton A500/amyl acetate solution to a mixture of 0.680 g of Al (40–70 nm), 1.320 g of $MoO_3$ (nano), and 0.200 g of boron (nano) and mixing well. Two 1 μL drops of the initiator composition were placed in a 0.06 inch diameter hole in a 1.5 inch by 1.75 inch fiberglass mat (0.04 inch thickness, Directed Light). One drop of initiator composition was place in the hole from each side of fiberglass mat.

To assemble the heating unit, double sided tape (2 inches by 2.25 inches by 0.375 inch wide, Saint-Gobain Performance Plastics) as place on the fuel coated foil (2 inches by 2.25 inches). A spacer (2 inches by 2.25 inches by 0.1 inches thick, Maakrolon) was placed on the double sided tape. First, the fiberglass mat with the initiator and then two other fiberglass mats with the holes (0.1 inch diameter) were placed in the spacer and positioned such the holes for the fiberglass mats were aligned. On the other side of the spacer was placed double sided tape. This was then covered with a 2 inch by 2.25 inch window made out of clear plastic (1/16 inch polycarbonate sheet, McMaster-Carr).

The heating unit was ignited by pulsed flash light from a Xenon lamp powered by one AA battery with associated electronic circuitry.

Example 10

Heating Unit Embodiment with Percussive Ignition using Initiator Composition The preparation of a heating unit according to FIG. 8 using percussion ignition is described below.

The following procedure is used to prepare solid fuel coatings comprising 76.16% Zr:19.04% $MoO_3$:4.8% Laponite® RDS.

To prepare wet Zirconium (Zr), the as-obtained suspension of Zr in DI water (Chemetall, Germany) is agitated on a roto-mixer for 30 minutes. Ten to 40 mL of the wet Zr is dispensed into a 50 mL centrifuge tube and centrifuged (Sorvall 6200RT) for 30 minutes at 3,200 rpm. The DI water is removed to leave a wet Zr pellet.

To prepare a 15% Laponite® RDS solution, 85 grams of DI water is added to a beaker. While stirring, 15 grams of Laponite® RDS (Southern Clay Products, Gonzalez, Tex.) is added, and the suspension stirred for 30 minutes.

The reactant slurry is prepared by first removing the wet Zr pellet as previously prepared from the centrifuge tube and placing it in a beaker. Upon weighing the wet Zr pellet, the weight of dry Zr is determined from the following equation: Dry Zr (g)=0.8234 (Wet Zr(g))−0.1059.

The amount of molybdenum trioxide to provide a 80:20 ratio of Zr to $MoO_3$ is then determined, e.g, $MoO_3$=dry Zr(g)/4, and the appropriate amount of $MoO_3$ powder (Accumet, N.Y.) is added to the beaker containing the wet Zr to produce a wet Zr:$MoO_3$ slurry. The amount of Laponite® RDS to obtain a final weight percent ratio of dry components of 76.16% Zr:19.04% $MoO_3$:4.80% Laponite® RDS is determined. Excess water to obtain a reactant slurry comprising 40% DI water is added to the wet Zr and $MoO_3$ slurry. The reactant slurry is mixed for 5 minutes using an IKA Ultra-Turrax mixing motor with a S25N-8G dispersing head (setting 4). The amount of 15% Laponite® RDS previously determined is then added to the reactant slurry, and mixed for an additional 5 minutes using the IKA Ultra-Turrax mixer. The reactant slurry is transferred to a syringe and stored for at least 30 minutes prior to coating.

The Zr:$MoO_3$:Laponite® RDS reactant slurry is then coated onto stainless steel foils. Stainless steel foils are first cleaned by sonication for 5 minutes in a 3.2% by solution of Ridoline 298 in DI water at 60° C. Stainless steel foils are masked with 0.215 inch wide Mylar® such that the center portion of each 0.004 inch thick 304 stainless steel foil is exposed. The foils are placed on a vacuum chuck having 0.008 inch thick shims at the edges. Two (2) mL of the reactant slurry is placed at one edge of the foil. Using a Sheen Auto-Draw Automatic Film Applicator 1137 (Sheen Instruments) the reactant slurry is coated onto the foils by drawing a #12 coating rod at an auto-draw coating speed of up to 50 mm/sec across the surface of the foils to deposit approximately an 0.006 inch thick layer of the Zr:$MoO_3$:Laponite® RDS reactant slurry. The coated foils are then placed in a 40° C. forced-air convection oven and dried for at least 2 hours. The masks are then removed from the foils to leave a coating of solid fuel on the center section of each foil.

The ignition assembly comprising a thin stainless steel wire (wire anvil) is dip coated ¼ an inch in an initiator composition in amyl acetate comprising 26.5% Al, 51.4% $MoO_3$, 7.7% B and 14.3% Viton A500 weight percent based on dry weight. The coated wire is then dried at about 40–50° C. for 1 hour. The dried coated wire is placed into an ignition tube (soft walled aluminum tube 0.003 inch wall thickness) and one end is crimped to hold the wire in place.

To assemble the heating unit, the ignition tube is placed between two fuel coated foil substrates (fuel chips) with the open end of the ignition tube aligned with the edge of the fuel coatings on the fuel chips. The fuel chips are sealed with aluminum adhesive tape.

To ignite the solid fuel, the ignition tube is struck with a brass rod.

In an alternative embodiment of this Example 10, the ignition assembly comprised a thin stainless steel wire (wire anvil) dip coated ¼ an inch in an initiator composition comprising 620 parts by weight of titanium (size less than 20 μm), 100 part by weight of potassium chlorate, 180 parts by weight red phosphorus, 100 parts by weight sodium chlorate, and 620 parts by weight water with 2% polyvinyl alcohol binder. The coated wire was then dried at about 40–50° C. for 1 hour. The dried coated wire was placed into an ignition tube (soft walled aluminum tube 0.003 inch wall thickness) and one end was crimped to hold the wire in place.

Although the invention has been described with respect to particular embodiments, and within the context of heating units for use in medical devices, it will be apparent to those skilled in the art that various changes and modifications can be made without departing from the invention such as applications of these initiator compositions and igniters to various other systems that need either low gas emitting compositions and/or low voltage igniter.

What is claimed is:

1. An initiator composition comprising a mixture including a. a metal containing oxidizing agent b. a metal reducing agent, and c. a non-explosive binder, wherein said mixture is characterized by release of a total amount of energy of 0.25 J to 8.5 J upon actuation and a deflagration time of 5 to 30 milliseconds at a composition thickness of 20 to 100 microns.

2. The initiator composition of claim 1, wherein said mixture is characterized by a deflagration time of 5 to 20 milliseconds at a composition thickness of 40 to 100 microns.

3. The initiator composition of claim 1, wherein said mixture is characterized by a deflagration time of 5 to 10 milliseconds at a composition thickness of 40 to 80 microns.

4. The initiator composition of claim 1, wherein said metal reducing agent is selected from the group consisting of aluminum, zirconium and boron.

5. The initiator composition of claim 1, wherein said metal containing oxidizing agent is selected from at least one of the following: a chlorate of an alkali, a chlorate of an alkali earth metal, a perchlorate of an alkali metal, a perchlorate of an alkali earth metal, and an oxide of a metal.

6. The initiator composition of claim 5, wherein the said metal containing oxidizing agent is selected from at least one of the following: molybdenum trioxide, copper oxide, tungsten trioxide, potassium chlorate, and potassium perchlorate.

7. The initiator composition of claim 1, wherein the composition comprises at least two metal reducing agents.

8. The initiator composition of claim 7, wherein at least one of the at least two metal reducing agents is boron.

9. The initiator composition of claim 8, wherein said composition comprises about 7–10% by weight of boron, based on total composition dry weight.

10. The initiator composition of claim 1, wherein both the metal reducing agent and the metal-containing oxidizing agent comprise powders.

11. The initiator composition of claim 10, wherein at least one of the metal reducing agent and the metal-containing agent comprise a powder of nanoparticle size.

12. The initiator composition of claim 10, wherein both the metal reducing agent and the metal-containing oxidizing agent comprise powders of nanoparticle size.

13. The initiator composition of claim 1, wherein said composition comprises about 25–75% by weight of said oxidizing agent, based on total composition dry weight.

14. The initiator composition of claim 1, wherein said composition comprises about 25–75% by weight of said reducing agent, based on total composition dry weight.

15. The initiator composition of claim 1, wherein said composition comprises less than about 15% by weight of said binder, based on total composition dry weight.

16. The initiator composition of claim 1, wherein said composition comprises less than about 5% by weight of said binder, based on total composition dry weight.

17. The initiator composition of claim 15, wherein the binder is inert.

18. The initiator composition of claim 17, wherein the binder is selected from the group consisting of fluoro-carbon rubber and synthetic layered silicate.

19. The initiator composition of claim 1, wherein said initiator composition is for use with electrical resistance actuation.

20. The initiator composition of claim 1, wherein said initiator composition is for use with percussion actuation.

21. The initiator composition of claim 1, wherein said initiator composition is for use with optical actuation.

22. The initiator composition of claim 21, wherein said optical actuation is provided by a flashbulb.

23. The initiator composition of claim 1, wherein the metal containing oxidizing agent comprises molybdenum trioxide, the metal reducing agent comprises aluminum and boron, and the non-explosive binder comprises fluoro-carbon rubber.

24. An initiator composition comprising about 26–27% by weight of aluminum, about 51–52% by weight of molybdemun trioxide, about 7–8% by weight of boron, and about 14–15% by weight of fluoro-carbon rubber, based on total composition dry weight.

* * * * *

UNITED STATES PATENT AND TRADEMARK OFFICE

CERTIFICATE OF CORRECTION

PATENT NO. : 7,402,777 B2
APPLICATION NO. : 10/851018
DATED : July 22, 2008
INVENTOR(S) : Ron et al It is certified that error appears in the above-identified patent and that said Letters Patent is hereby corrected as shown below:

The citation which appears at column 5, line 8 of the patent:
WO 2004/01396 should be corrected to read:
WO 2004/011396

Signed and Sealed this

Thirtieth Day of June, 2009

John Doll

JOHN DOLL
*Acting Director of the United States Patent and Trademark Office*